US006623104B1

(12) United States Patent
Kotaki et al.

(10) Patent No.: US 6,623,104 B1
(45) Date of Patent: Sep. 23, 2003

(54) LIQUID CONTAINER, CAP USED WITH THE LIQUID CONTAINER, AND CAP-EQUIPPED LIQUID CONTAINER

(75) Inventors: Yasuo Kotaki, Kanagawa-ken (JP); Tsutomu Abe, Kanagawa-ken (JP); Shigeyuki Nakayama, Tokyo (JP); Masashi Ogawa, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 138 days.

(21) Appl. No.: 09/678,024

(22) Filed: Oct. 4, 2000

(30) Foreign Application Priority Data

Oct. 4, 1999 (JP) ..... 11-283410

(51) Int. Cl.[7] ..... B41J 2/14; B41J 2/175
(52) U.S. Cl. ..... 347/49; 347/86
(58) Field of Search ..... 347/84–87, 49

(56) References Cited

U.S. PATENT DOCUMENTS

2002/0175977 A1 * 11/2002 Hanson et al. ..... 347/86

* cited by examiner

*Primary Examiner*—Judy Nguyen
(74) *Attorney, Agent, or Firm*—Fitzpatrick, Cella, Harper & Scinto

(57) ABSTRACT

A liquid container includes a lever having one end supported to an outer wall of a housing containing a liquid therein and the other end as a free end, the lever being elastically deformable. The liquid container further includes a projection provided in an area of the housing which is opposite to and away from the supported one end of the lever, the projection covering at least a part of a space between the free end of the lever and the housing in the above area. By virtue of the projection, the lever can be protected against accidental external forces. In a cap-equipped liquid container, a straight line connecting a projected end of the projection of the liquid container and a distal end of a tab of a cap is set to cross a movable range of the lever provided on the liquid container in which the lever is allowed to angularly move with elastic deformation thereof. In a cap, an elastic sealing member for sealing off the surroundings of the supply port of the liquid container is provided on a bottom wall portion connecting first and second latch members to each other, and a part of the bottom wall portion is able to elastically deform upon application of an operating force.

6 Claims, 18 Drawing Sheets

LIQUID CONTAINER, CAP USED WITH THE LIQUID CONTAINER, AND CAP-EQUIPPED LIQUID CONTAINER

BACKGROUND OF THE INVENTION

1. Field of the Invention

The present invention relates to a liquid container and a cap for sealing off a supply port of the liquid container. More particularly, the present invention relates to an ink tank for use with an ink jet recording head in which an ink is ejected for recording, and a cap for sealing off an ink supply port of the ink tank.

2. Description of the Related Art

There is known a combination of a liquid ejection recording head (ink jet recording head) in which a liquid (taking an ink as an example in the following description) is ejected for recording, and a liquid container (ink tank) for containing the ink supplied to the recording head. From the viewpoint of operating cost, the combination has been hitherto often practiced such that the ink tank is attached to the recording head in a detachable manner. In the case of manufacturing the recording head and the ink tank detachably fitted to each other, it is required that the ink tank be attached to the recording head with an easier operation or a simpler mechanism without causing troubles when attached to and detached from the recording head.

In Japanese Patent Laid-Open No. 8-58107, No. 8-224883 and No. 8-276601, for example, the assignee discloses an ink tank which has an ink supply port for supplying a recording ink contained therein to the outside through the same and which is inserted into an opening of a box-shaped ink tank holder in a detachable manner, the ink supply port being communicated with an ink taking-in means of the ink tank holder when the ink tank is attached to the ink tank holder. In the ink tank, a slope is formed at an edge where a bottom surface, which faces a bottom wall of an opening of the ink tank holder when the ink tank is attached to the ink tank holder, crosses one end surface adjacent to the bottom surface. Further, a claw-like projection fitted to a slip-off check hole formed in the ink tank holder is provided on the one end surface, and a latch lever having a latch claw, which engages in an engagement hole formed in the ink tank holder, is provided on the other end surface in a flexibly supported manner. The invention disclosed in these patents is superior in coupling the ink tank and the recording head to each other, and is practiced in many ink tanks.

Meanwhile, to prevent an ink leakage through the ink supply port when the ink tank is handled alone (e.g., during a distribution process), a cap is usually attached to the ink supply port of the ink tank. In general, such a cap has a sealing member made of an elastic material for positively sealing off the ink supply port. The sealing member is provided on a surface of a cap body which has a rigidity, and hooks engaging with the ink tank are provided respectively on opposing surfaces of the cap body projected from the rigid surface. One of the opposing surfaces has a tab provided thereon which is pulled by the user at the time of removing the cap from the ink tank. When the user holds the ink tank and pulls the tab, the surface of the cap body including the tab provided thereon is elastically deformed so that the cap may be removed from the ink tank.

With a recent improvement in performance of an ink jet recording head, there is a tendency that many different kinds of inks are used interchangeably in the ink jet recording head. This tendency leads to a result that a material vulnerable to repeated bending is employed as the material of an ink tank body in some cases depending on the kinds of inks used. In trying to fabricate the ink tank, which as disclosed in the above-cited Japanese Patent Laid-Open No. 8-58107, etc. has a latch lever, using such a material, a risk has been found in that when the ink tank is handled in an unexpected way far from the normal one, e.g., when the user puts a finger between the ink tank body and the latch lever and applies a force to the finger in a direction of moving the latch lever away from the ink tank body, the latch lever may be detached from the ink tank body.

On the other hand, the following problem has been experienced with the cap of the ink tank. Because the surface of the ink body including the elastic sealing member provided thereon has a strong rigidity, a large force is required to disengage the hooks from the ink tank at the time of removing the cap from the ink tank. In addition, almost as soon as the hooks are disengaged, the cap is removed from the ink tank. Therefore, particularly when the ink tank has a small size, there is a risk that, depending on how the ink tank is held by the user, the ink may scatter through the ink supply port, or one or both of the ink tank and the cap may slip off and drop from the user's hand.

SUMMARY OF THE INVENTION

The present invention has been made by the inventors with the view of addressing the above problems that have been experienced with an ink tank that is separable from a recording head. A first object of the present invention is to provide a liquid container and a cap-equipped liquid container in which a lever is protected without causing wasteful use of a space otherwise necessary for attaching the liquid container.

A second object of the present invention, which is to be realized in addition to the first object or alone, is to provide a cap capable of being easily removed by the user even when the cap is applied to a small-sized ink tank, and capable of reliably protecting an ink supply port.

To achieve the above objects, the present invention provides a liquid container comprising a lever having one end supported to an outer wall of a housing containing a liquid therein and the other end as a free end, the lever being elastically deformable, wherein the liquid container further comprises a projection provided in an area of the housing which is opposite to and away from the supported one end of the lever, the projection covering at least a part of a space between the free end of the lever and the housing in said area.

The lever provided on the liquid container is used in operation for attaching the liquid container to a holder or the like. According to the liquid container of the present invention, the projection covering at least a part of the area between the free end of the lever and the housing is provided at the above-defined location of the housing of the liquid container. With such a construction, which is easy to manufacture, it is possible to prevent an accidental external force from being exerted on the free end of the lever that is otherwise particularly easily subjected to an accidental external force. Further, since the projection is provided in the above-defined area of the housing, the projection will not interfere with the operation of attaching the liquid container to the holder or the like, and therefore wasteful use of a space necessary for attaching and detaching the liquid container is avoided.

The present invention also provides a cap-equipped liquid container comprising the above-described liquid container of the present invention and a cap fitted to the liquid container, the cap comprising an elastic sealing member for sealing off a supply port formed in the liquid container to introduce a liquid in the liquid container out of the liquid container, and a cap body on which the elastic sealing member is provided, wherein the cap body includes an engagement member engaging with the liquid container to hold the cap in place, and a tab disposed near the engagement member and used for removing the cap from the liquid container. A straight line connecting a projected end of the projection of the liquid container and a distal end of the tab is set to cross a movable range of the lever provided on the liquid container in which the lever is allowed to angularly move with elastic deformation thereof.

With the cap-equipped liquid container of the present invention, since the straight line connecting the projected end of the projection of the liquid container and the distal end of the tab of the cap is set to cross the movable range of the lever in which the lever is allowed to angularly move with elastic deformation thereof, the lever will not deform beyond the allowable range of elastic deformation even when an impact is accidentally exerted on the liquid container upon a fall, for example. Also, when the projected end of the projection of the liquid container and the distal end of the tab of the cap strike against a flat plane, the lever is elastically deformed until the free end thereof reaches the above straight line, thereby dampening an applied impact through the elastic deformation of the lever.

The present invention further provides a cap fitted to a liquid container having a supply port formed in a bottom wall thereof for supplying a liquid in the liquid container out of the liquid container, wherein the cap comprises a first latch member engaging with a first engagement member provided on one side wall of the liquid container; a second latch member engaging with a second engagement member provided on the other side wall of the liquid container opposite to the one side wall on which the first engagement member is provided; a bottom wall portion connecting the first engagement member and the second engagement member to each other and including an elastic sealing member provided thereon for sealing off surroundings of the supply port; and a tab provided near the first latch member to lie in a direction of extension of the bottom wall portion and used for removing and fitting the cap from and to the liquid container, a part of the bottom wall portion being able to elastically deform with application of an operating force for removing the cap from the liquid container.

With the cap of the present invention, the cap is fitted to the liquid container by engaging the first and second latch members respectively with the first and second engagement members provided on the opposing side walls of the liquid container. The elastic sealing member for sealing off the surroundings of the supply port of the liquid container is provided on the bottom wall portion connecting the first and second latch members to each other, and therefore the supply port is protected by the bottom wall portion. Also, since the tab used in the operation of removing the cap is provided near the first latch member to lie in the direction of extension of the bottom wall portion, the first latch member is first disengaged and the second latch member is then disengaged. In this connection, since a part of the bottom wall portion is able to elastically deform upon application of the operating force for removing the cap from the liquid container, a shock occurred upon opening the supply port of the liquid container is reduced and the cap can be easily removed without troubles.

Further objects, features and advantages of the present invention will become apparent from the following description of the preferred embodiments with reference to the attached drawings.

BRIEF DESCRIPTION OF THE DRAWINGS

FIG. 4A is a bottom view showing one example of the construction of a monochrome ink tank holder to which a black ink tank containing only a black ink is fitted, and FIG. 4B is a bottom view showing one example of the construction of a color ink tank holder to which a color ink tank containing multiple color inks is fitted;

FIG. 5A is a side view, FIG. 5B is a bottom view including an ink supply port, and FIG. 5C is a perspective view;

FIG. 6A is a side view, FIG. 6B is a bottom view including an ink supply port, and FIG. 6C is a perspective view;

FIG. 7A is a side view, FIG. 7B is a bottom view including an ink supply port, and FIG. 7C is a perspective view;

DESCRIPTION OF THE PREFERRED EMBODIMENTS

The present invention will be described below in detail with reference to the drawings.

Figure 1:
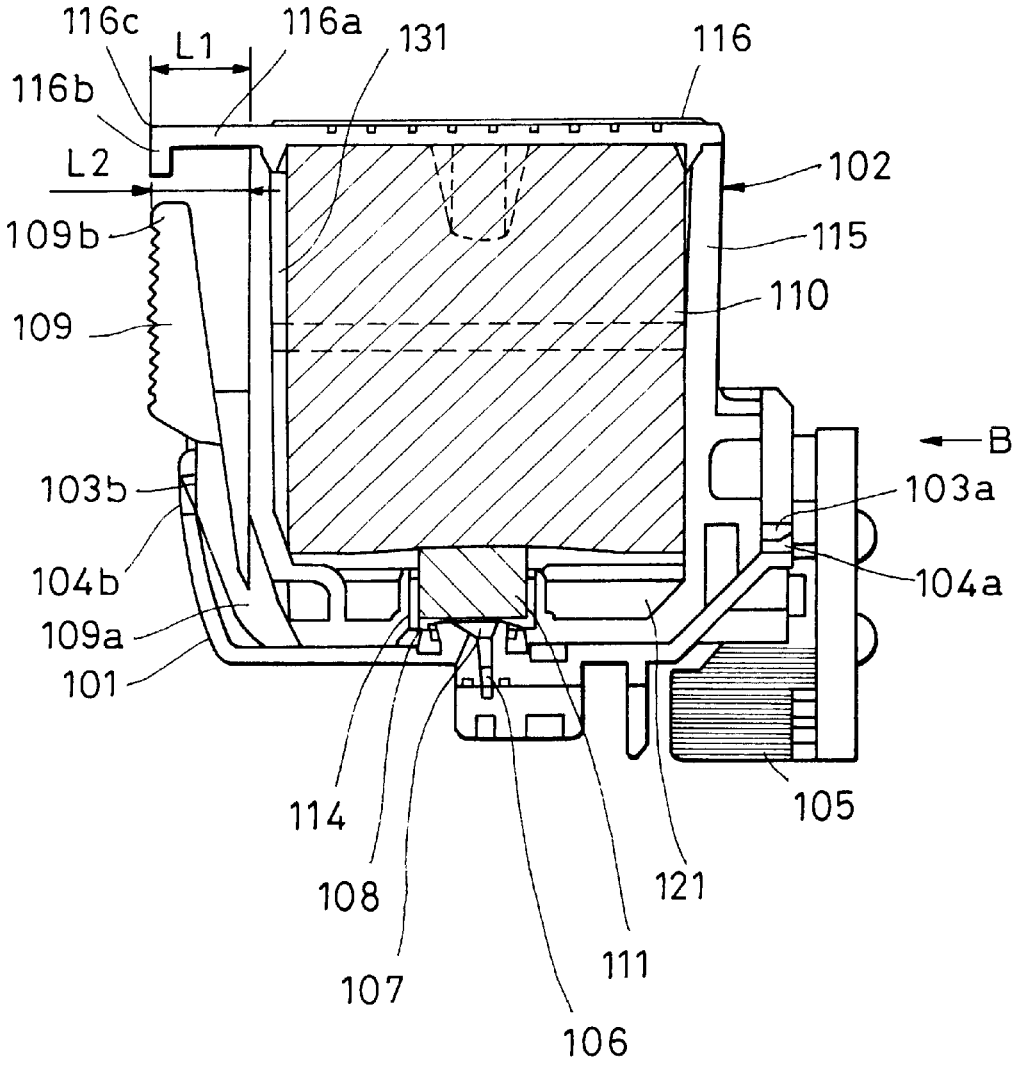
FIG. 1 is a sectional view showing the structure of an ink tank of the present invention.

First, an overall construction of the ink tank of the present invention will be described with reference to FIG. 1. FIG. 1 is a sectional view showing the structure of the ink tank according to one embodiment of the present invention, and FIG. 2 is a side sectional view showing the structure of the ink tank shown in FIG. 1, as viewed in the direction of arrow B.

As shown in FIG. 1, an ink tank 102 is provided with a first engagement member (latch claw) 103*b* and a second engagement member 103*a* for fixing the ink tank 102 to an ink tank holder 101 including a recording head 105. The ink tank 102 is fixedly attached to the ink tank holder 101 by fitting the second engagement member 103*a* to an opening 104*a* formed in the ink tank holder 101 as a second catch member for catching the second engagement member 103*a* to be locked in place, and by fitting the first engagement member 103*b* to an opening 104*b* formed in the ink tank holder 101 as a first catch member for catching the first engagement member 103*b* to be locked in place. The second engagement member 103*a* is provided on one side wall surface of the ink tank 102, and the first engagement member 103*b* is provided on a latch lever 109 that is provided in a flexibly supported manner on the other side wall surface of the ink tank 102 opposite to the one side wall surface.

When the ink tank 102 is thus attached to the ink tank holder 101, a filter 107 disposed at an end of an ink passage 106, through which ink is supplied to the recording head 105, is forced to enter the ink tank 102 through an ink supply port 108 formed in a wall surface of the ink tank 102 which defines the bottom of the ink tank in a condition where it is in use. Then, the filter 107 is brought into pressure contact with a supply member 111 fitted in the ink supply port 108 to establish an ink flow passage, thus enabling the ink to be supplied to the recording head 105.

Figure 2:
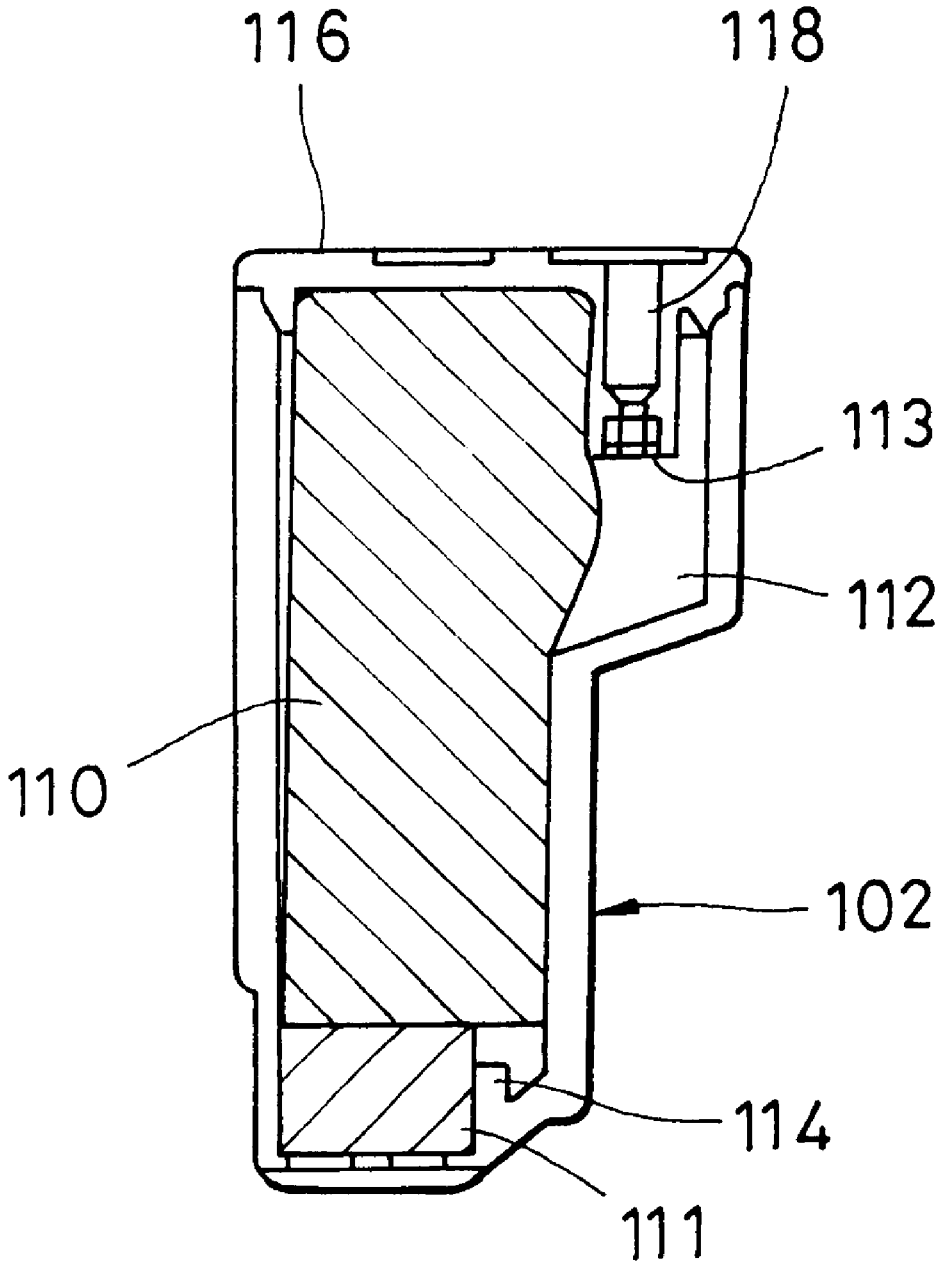
FIG. 2 is a side sectional view showing the structure of the ink tank shown in FIG. 1, as viewed in the direction of arrow B.

Referring to FIG. 2, the ink tank 102 includes therein an absorbing member 110 for absorbing and retaining the ink, and a supply member 111 interposed between the absorbing member 110 and the ink supply port 108 (see FIG. 1) for delivering the ink from the absorbing member 110 to the ink tank holder 101 (see FIG. 1). Also, the ink tank 102 includes a buffer chamber 112 for temporarily holding the ink leaked from the absorbing member 110 to the interior of the ink tank 102, and an atmosphere communication port 113 for communicating the interior of the ink tank 102 with the atmosphere to maintain a pressure in the interior of the ink tank 102 at the atmospheric pressure.

An inner end opening of the atmosphere communication port 113 is located substantially at the center of the buffer chamber 112 so that, when the ink leaks from the absorbing member 110 to the interior of the ink tank 102, the ink will not leak to the exterior regardless of the orientation that the ink tank 102 takes.

The absorbing member 110 and the supply member 111 are each formed of a fiber absorber that is fabricated by compressing a bundle of fibers made of a polyolefin-based resin and having directionality, and then joining the fibers with each other by fusing so as to have a density suitably set for each member. The fiber absorber is cut into a predetermined size and placed in the ink tank.

Figure 3:
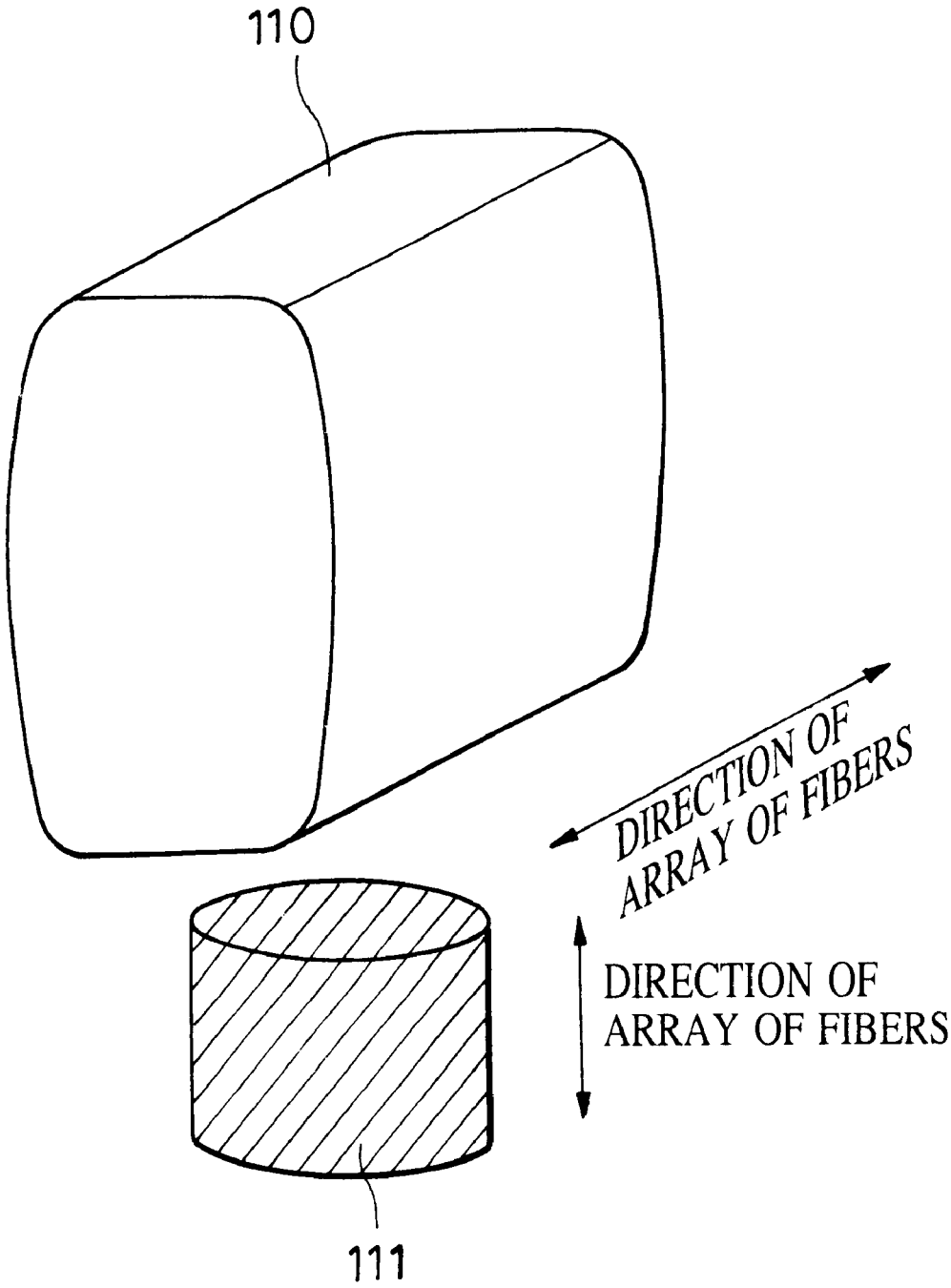
FIG. 3 is a perspective view showing the shapes of an absorbing member and a supply member shown in FIG. 1 and the directions of array of fibers in both the members.

As shown in FIG. 3, the absorbing member 110 is an elastic convex member bulging outward on both sides, and generates reaction forces to expand when placed in the ink tank 102 in a compressed state. Also, in this embodiment, the absorbing member 110 is formed to have a higher fiber density in its outer peripheral portion than that in its inner portion for the purpose of increasing an ability of the outer peripheral portion to retain the ink therein.

The supply member 111 is placed in the ink tank 102 such that the fibers forming the supply member 111 are arrayed in a direction crossing, preferably vertically, the surface of the filter 107, and the absorbing member 110 is placed in the ink tank 102 such that the fibers forming the absorbing member 110 are arrayed in a direction crossing, preferably perpendicularly, the direction of array of the fibers forming the supply member 111. With such an arrangement, the ink can be supplied to the recording head 105 with stability while generating a negative pressure appropriate to hold the ink.

Further, as shown in FIG. 1, a bottom buffer chamber 121 is formed between an inner bottom surface of the ink tank 102 and the absorbing member 110 to prevent the ink, which has moved toward the inner bottom surface of the ink tank 102, from concentrating in the vicinity of the supply member 111 and leaking to the exterior through the ink supply port 108. Additionally, the bottom buffer chamber 121 is communicated with the buffer chamber 112 formed in the ink tank 102 on one side through a vacant space 131 defined as a gap left between an inner wall surface of the ink tank 102 and the absorbing member 110.

A housing of the ink tank 102 is made up of a tank body 115, which contains the absorbing member 110 and the supply member 111 therein, and a lid 116. In this embodiment, the lid 116 closes an opening at the top of the ink tank 102 positioned in opposite relation to the ink supply port 108 formed at the bottom of the ink tank in a condition where it is in use. Also, in this embodiment, the lid 116 includes a projection 116*a* that is located above the latch lever 109 and is projected from the tank body 115 in a direction of covering the latch lever 109 arranged to extend along the side wall surface of the tank body 115.

The projection 116*a* will be described in more detail. In this embodiment, the projection 116*a* has a bent portion 116*b* formed at its projected end. The lid 116 has a thickness of about 1 mm, and the bent portion 116*b* (having a length of about 4 mm) serves to surely keep the user from putting a finger accidentally between the latch lever 109 and the side wall surface of the tank body 115 to which a base end of the latch lever 109 is attached. As a result, an accidental external force is avoided from exerting upon the latch lever 109, and the latch lever 109 is prevented from being detached from the tank body 115. Also, the projection 116*a* is provided in a position above the latch lever 109, i.e., in such a position that the projection 116*a* will not be positioned within the ink tank holder 101 in a state where the ink tank 102 is attached to the ink tank holder 101. Accordingly, the projection 116*a* neither interferes with the operation of attaching the ink tank 102, nor causes wasteful use of a space necessary for attaching the ink tank 102.

While the projection 116*a* is provided integrally with the lid 116 in this embodiment for the purpose of easier molding of the tank body 115, it may be provided on the side wall surface of the tank body 115. In other words, the projection 116*a* may be disposed on the side wall surface of the tank body 115, which is opposite to a lever portion (between a fulcrum portion 109*a* and a free end 109*b* of the latch lever 109), in an area away from the fulcrum portion 109*a* so as to cover at least a part of a space between the free end 109*b* and the housing of the ink tank 102. Where the projection 116*a* is provided on the side wall surface of the tank body 115, the projection 116*a* can be disposed in a position closer to the free end 109*b* of the latch lever 109 than in the illustrated embodiment, and the distance between the projection 116*a* and the free end 109*b* of the latch lever 109 in the vertical direction can be set to a smaller value. With such a modified arrangement, it is possible to prevent an accidental external force from exerting on the latch lever 109 without providing the bent portion 116*b*. Even in the case of providing the projection 116*a* on the lid 116, the bent portion 116*b* is not necessarily provided, particularly if the projection 116*a* can be disposed in a position close to the free end 109*b* of the latch lever 109.

Further, as shown in FIGS. 5 to 7 and 11 described later, when the ink tank 102 is manufactured or it is handled or left alone, the spacing between the free end 109*b* of the latch lever 109 and the side wall surface of the tank body 115, to which the fulcrum portion 109*a* is attached, is preferably set to be not greater than 5 mm, more preferably not greater than 3 mm. Moreover, in a state where the ink tank 102 is attached to the ink tank holder 101 including the recording head 105 as shown in FIG. 1, a distance L1 from a base end of the projection 116*a* to a projected end 116*c* thereof and a distance L2 from the side wall surface of the tank body 115, to which the latch lever 109 is attached, to the free end 109*b* of the latch lever 109 are preferably set to satisfy the relationship of $L1 \geqq L2$. More preferably, the relationship of $L1=L2$ should be satisfied because no trouble occurs in the operation of attaching and detaching the ink tank 102 using the latch lever 109 under such a relationship.

A description will be made below of a recording head cartridge on which the ink tank of the present invention is mounted with reference to FIGS. 4A and 4B, and of the ink tank of the present invention with reference to FIGS. 5 to 7.

The recording head cartridge comprises a nozzle portion constructed by a recording head for ejecting an ink in accordance with a recording signal in the form of an electrical signal for the ink ejection, and an ink tank holder for holding an ink tank in a detachable manner which contains the ink therein. The nozzle portion is provided at the bottom of the recording head cartridge, and the ink is ejected downward from the recording head cartridge.

Figure 4A:
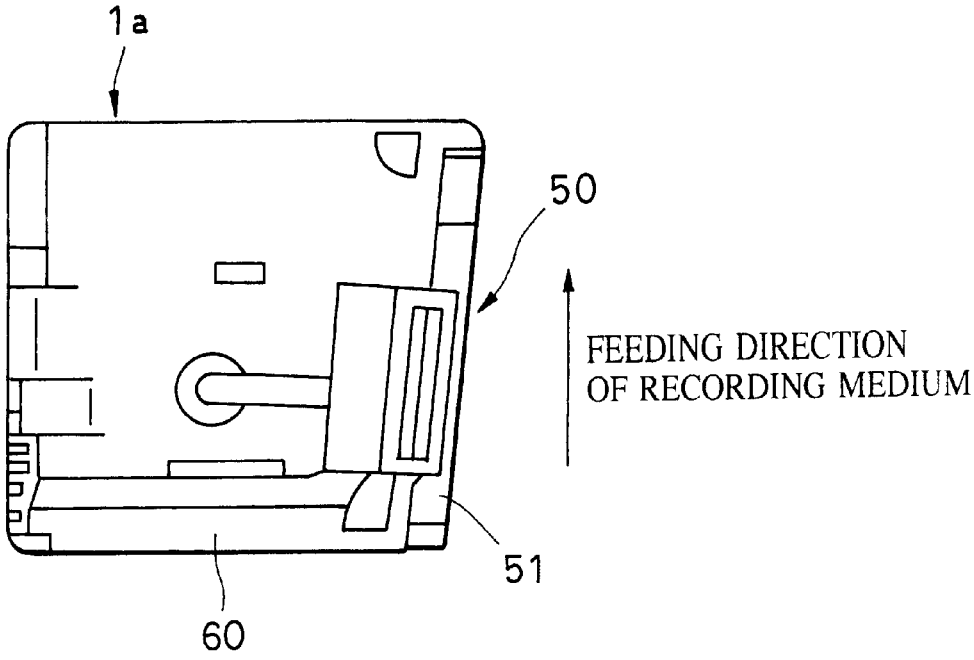
FIGS. 4A and 4B each show the construction of a recording head cartridge including an ink tank holder.
Figure 4B:
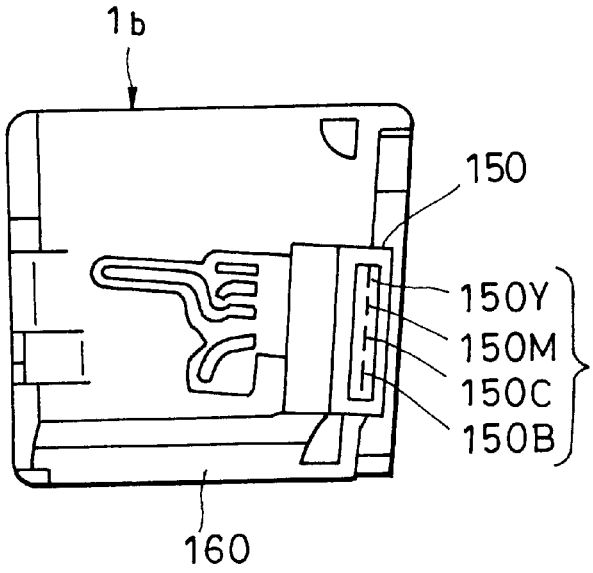

FIGS. 4A and 4B each show the construction of the recording head cartridge including the ink tank holder; FIG. 4A is a bottom view showing one example of the construction of a monochrome ink tank holder to which a black ink tank containing only a black ink is fitted, and FIG. 4B is a bottom view showing one example of the construction of a color ink tank holder to which a color ink tank containing color inks is fitted.

A recording head cartridge la shown in FIG. 4A is a cartridge for monochrome printing, and comprises a nozzle portion 50 for ejecting a monochrome ink and a box-shaped monochrome ink tank holder 60 having an opening formed in its top wall surface, these two components 50, 60 being constructed into an integral unit. The ink tank containing the monochrome ink is detachably attached in the monochrome ink tank holder 60.

A not-shown electrothermal transducer (such as a heat generating resistor) for generating energy enough to eject the ink is disposed on a base plate 51 formed of a metal plate of aluminum or the like. Also, the base plate 51 has a head positioning cutout and a head positioning hole formed corresponding to positions of head positioning lugs 2*d*, 2*e* (see FIG. 18) provided in a carriage 2 described later. When the recording head cartridge 1*a* is mounted on the carriage 2, the head positioning lug 2*d* being rectangular in section is fitted to the head positioning cutout and the head positioning lug 2*e* being circular in section is fitted to the head positioning hole.

A recording head cartridge 1*b* shown in FIG. 4B includes a color ink tank holder 160 to which a black ink tank containing a black ink and a color ink tank containing inks of three colors, i.e., yellow, magenta and cyan, are detachably attached, thereby ejecting the inks of four colors. Corresponding to the inks of four colors, a nozzle portion 150 is also divided into a black orifice group 150B, a yellow orifice group 150Y, a magenta orifice group 150M, and a cyan orifice group 150C.

The recording head cartridge 1*b* including the color ink tank holder 160 shown in FIG. 4B and the recording head cartridge 1*a* including the monochrome ink tank holder 60 shown in FIG. 4A can be mounted on the same carriage so that any of monochrome and color printing can be achieved by selectively replacing the recording head cartridge as needed.

Figure 5A:
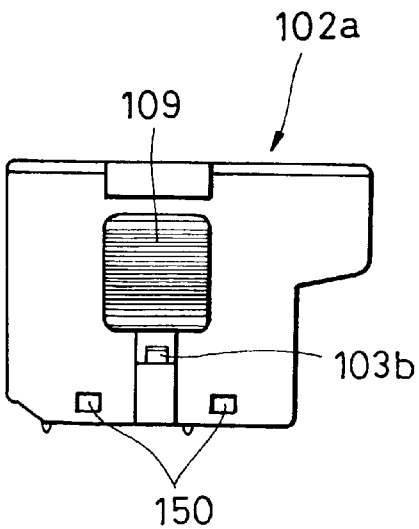
FIGS. 5A, 5B and 5C each show the shape of an ink tank containing a monochrome ink.
Figure 5B:
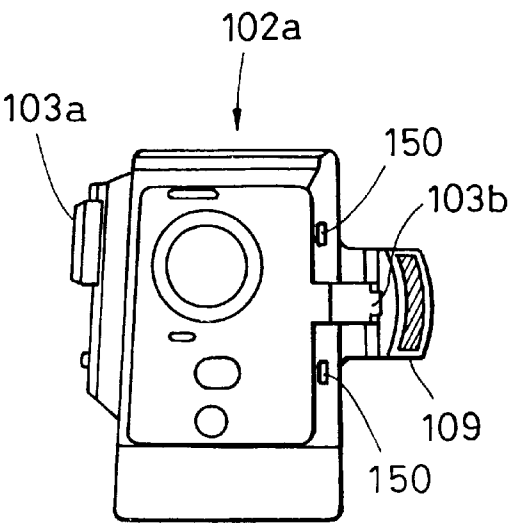
Figure 5C:
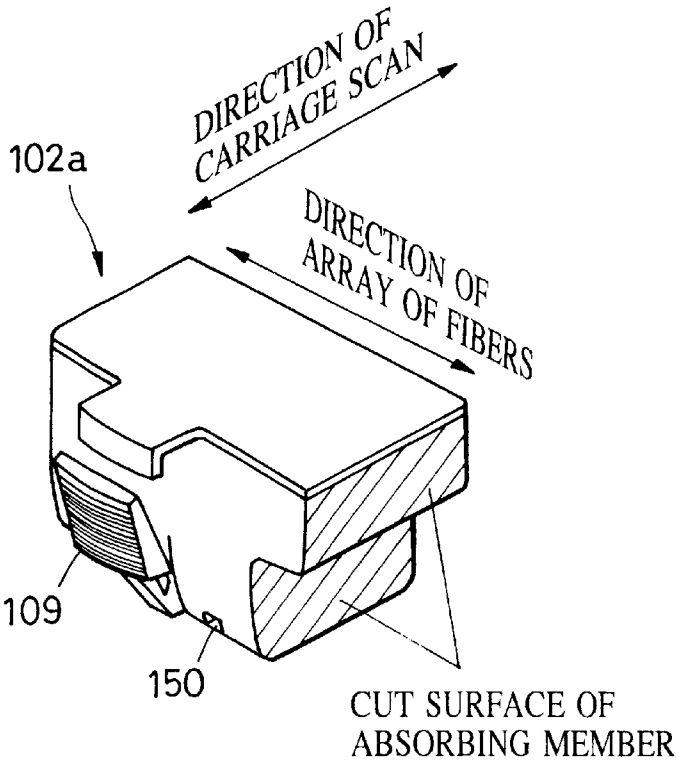

FIGS. 5A, 5B and 5C each show the shape of an ink tank 102*a* containing a monochrome ink; FIG. 5A is a side view, FIG. 5B is a bottom view including an ink supply port, and FIG. 5C is a perspective view. Since ink tanks shown in FIGS. 5 to 7 have the same basic construction as the ink tank shown in FIGS. 1 and 2, components having the same functions will be described using the same symbols unless otherwise specified.

In the ink tank 102*a* for monochrome printing shown in FIG. 5, an absorbing member and a supply member, which are each formed of a fiber absorber as with the above-mentioned ones, are placed to hold the monochrome ink under the action of capillary forces developed in the fiber absorber. The direction of array of fibers forming the fiber absorber of the absorbing member is set parallel to a direction toward a buffer chamber from the absorbing member, as shown in FIG. 5C. The absorbing member has convex surfaces bulging outward as shown in FIG. 3, and is placed in the ink tank 102*a* such that the convex surfaces are each positioned to contact an inner wall surface of the ink tank 102*a* which has a maximum area. This arrangement surely ensures close contact between the inner wall surfaces of the ink tank 102*a* and the absorbing member, and suppresses a shift of the absorbing member from the proper position. On the other hand, a cut surface of the fiber absorber of the absorbing member is positioned to contact an inner wall surface of the ink tank 102*a* which has a minimum area, as indicated by a hatched portion in FIG. 5C. The fiber absorber is cut in a direction substantially perpendicular to the direction of array of fibers. By so arranging the fiber absorber with the cut surface thereof positioned to contact the inner wall surface of the ink tank 102*a* which has a minimum area, an amount of the ink (free ink) flowing out of the absorbing member in the direction of array of fibers can be reduced to a minimum.

Further, since the direction of array of fibers forming the absorbing member is arranged in a direction crossing the direction of carriage scan (horizontally perpendicular to the direction of gravity) as shown in FIG. 5C, an ink drift occurred within the fiber absorber upon movement of the carriage can be held down.

The monochrome ink tank shown in FIG. 5 can be attached to the monochrome ink tank holder 60 shown in FIG. 4A by fitting a latch member (latch claw) 103*b* provided on a latch lever 109 to an opening (not shown in FIG. 4A) formed in the monochrome ink tank holder 60 for catching the latch member 103*b* to be locked in place. Such an attachment mechanism having the latch lever enables the ink tank to be detachably attached to the ink tank holder with good operability while needing a small space. Additionally, in this embodiment, the absorbing member and the supply member placed in the ink tank 102*a* of FIG. 5 are made of respectively 6D (denier) and 2D fibers.

Figure 6A:
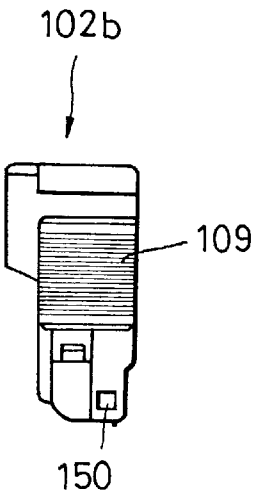
FIGS. 6A, 6B and 6C each show the shape of a black ink tank containing a black ink.
Figure 6B:
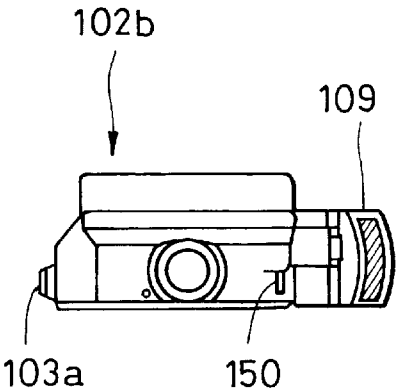
Figure 6C:
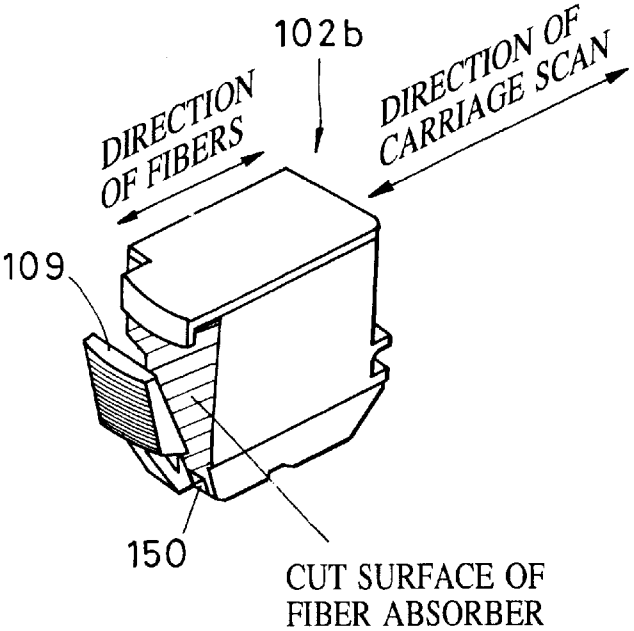
Figure 7A:
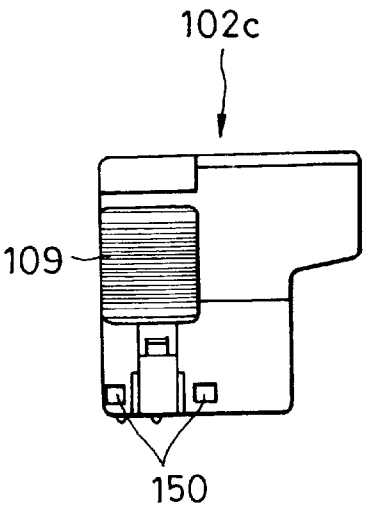
FIGS. 7A, 7B and 7C each show the shape of a color ink tank containing color inks.
Figure 7B:
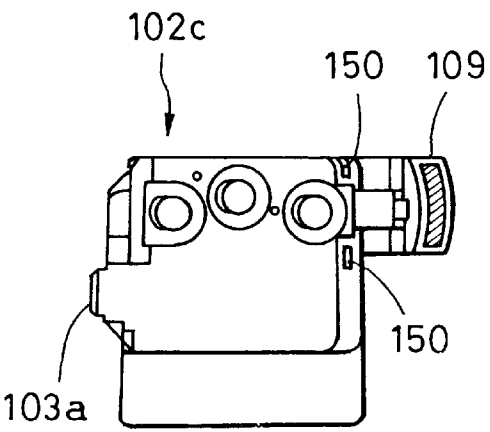
Figure 7C:
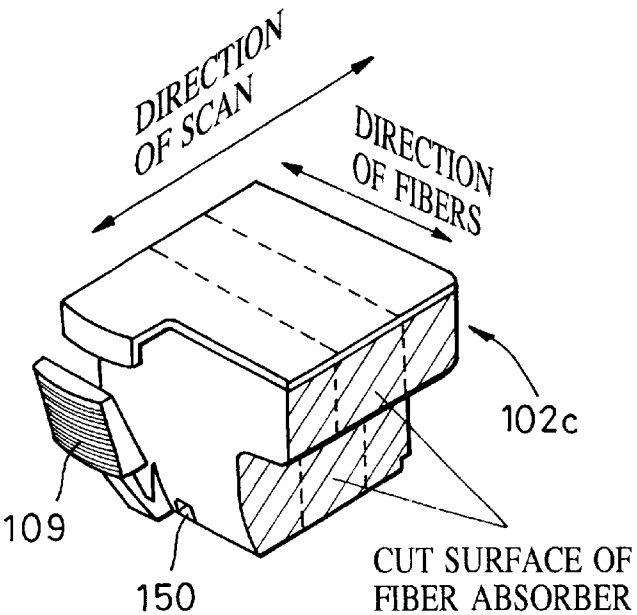

On the other hand, a black ink tank 102*b* shown in FIGS. 6A through 6C and a color ink tank 102*c* shown in FIGS. 7A through 7C can be attached to the color ink tank holder 160 shown in FIG. 4B, thus enabling the recording head cartridge 1*b* to supply the inks of four colors, i.e., yellow, magenta, cyan and black, to the recording head.

FIGS. 6A, 6B and 6C each show the shape of the black ink tank 102*b* containing the black ink; FIG. 6A is a side view, FIG. 6B is a bottom view including an ink supply port, and FIG. 6C is a perspective view. Also, FIGS. 7A, 7B and 7C each show the shape of the color ink tank 102*c* containing the color inks; FIG. 7A is a side view, FIG. 7B is a bottom view including an ink supply port, and FIG. 7C is a perspective view.

The black ink tank 102*b* shown in FIGS. 6A through 6C contains only the black ink and has a smaller size than the monochrome ink tank 102*a* shown in FIG. 5. An absorbing member and a supply member, each of which is formed of a fiber absorber, are both placed within the black ink tank 102*b* as with the monochrome ink tank 102*a* shown in FIG. 5. The ink absorbed in the absorbing member is expelled out of the black ink tank 102*b* through the supply member placed in the ink supply port, and the N introduced to the recording head.

The direction of array of fibers forming the fiber absorber of the absorbing member is set perpendicular to a direction toward a buffer chamber from the absorbing member, as shown in FIG. 6C. This arrangement is effective to suppress the ink within the black ink tank 102*b* from moving into the buffer chamber. Also, as with the monochrome ink tank 102*a* shown in FIG. 5, a cut surface of the fiber absorber is positioned to contact an inner wall surface of the black ink tank 102*b* which has a minimum area, as indicated by a hatched portion in FIG. 6C, and therefore an amount of the free ink can be reduced to a minimum. Moreover, since the direction toward the buffer chamber from the absorbing member crosses the direction of carriage scan, the movement of the ink into the buffer chamber can be further suppressed. The black ink tank 102*b* is attached to the color ink tank holder 160 using a latch lever 109 in a similar manner as the monochrome ink tank 102*a* shown in FIG. 5. Additionally, in this embodiment, the absorbing member and the supply member placed in the black ink tank 102*b* are both made of 6D (denier) fibers.

An inner space of the color ink tank 102*c* shown in FIGS. 7A through 7C is divided into three chambers in which the inks of yellow, magenta and cyan are contained respectively. Also, an absorbing member and a supply member, which are each formed of a fiber absorber as with the above-mentioned ones, are placed in each of the three chambers. In this embodiment, the absorbing member and the supply member are both made of 6D (denier) fibers similarly to those placed in the black ink tank 102*b*.

The direction of array of fibers forming the fiber absorber of the absorbing member is set as shown in FIG. 7C, that is to say, it is the same direction of array of fibers forming the absorbing member placed in the monochrome ink tank 102*a* shown in FIG. 5C. Also, likewise, a cut surface of the fiber absorber is positioned to contact an inner wall surface of each chamber of the color ink tank 102*a* which has a minimum area, as indicated by a hatched portion in FIG. 7C. Moreover, since the direction toward a buffer chamber from the absorbing member crosses (substantially perpendicular to) the direction of carriage scan, the ink can be avoided from moving into the buffer chamber. The color ink tank 102*c* is attached to the color ink tank holder 160 using a latch lever 109 in a similar manner as the monochrome ink tank 102*a*.

Ink tank caps fitted to the above-described ink tanks will be described below with reference to FIGS. 8 to 17.

Figure 8:
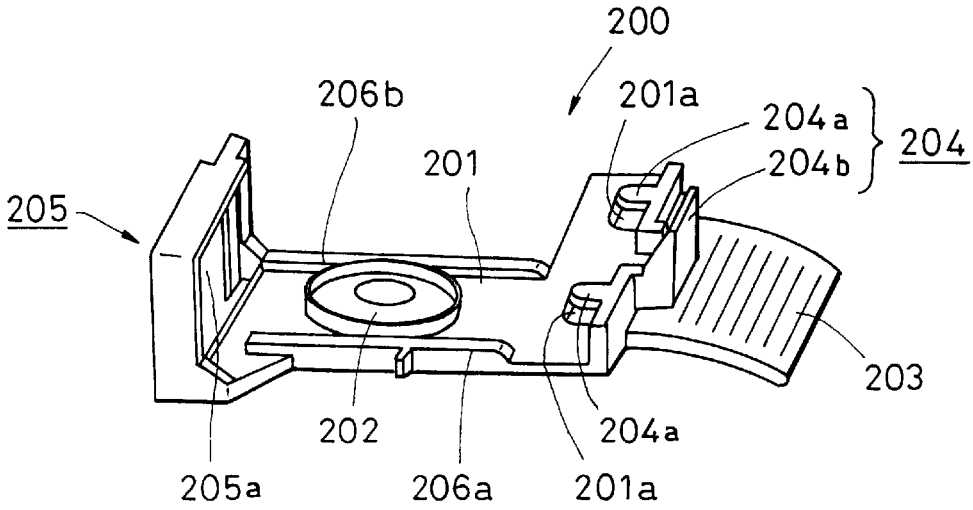
FIG. 8 is a perspective view showing a cap of the present invention applicable to the ink tank shown in FIG. 5.

FIG. 8 is a perspective view showing a cap applicable to the ink tank shown in FIG. 5. A cap 200 shown in FIG. 8 is made of a thermoplastic resin such as polypropylene, for example. The cap 200 comprises a bottom wall portion 201 provided with an elastic sealing member 202, which is made of rubber or the like, for sealing off around the ink supply port 108 (see FIG. 1), a first latch member 204 and a second latch member 205 serving as engagement members that engage with the ink tank, and a tab 203 used for attaching and detaching the cap 200 to and from the ink tank. The bottom wall portion 201, the first latch member 204, the second latch member 205 and the tab 203, are all integrally molded together to construct a cap body. An elastomer forming the elastic sealing member 202 is integrally provided on the cap body in a not-separable manner, for example, by being bonded to the cap body with an adhesive or by being formed with double molding or the like.

The tab 203 is formed in continuation with the bottom wall portion 201, namely, it is extended from the bottom wall portion 201 in the direction of extension thereof. Also, as seen from FIG. 8, the bottom wall portion 201 is sloped away from a lower surface of the bottom wall portion 201 opposite to an upper surface thereof on which the elastic sealing member 202 is provided, i.e., it is sloped in a direction in which the cap 200 is to be removed from the ink tank. Additionally, for the purpose of preventing slippage of the user's fingers when the user attaches and detaches the cap 200, thin grooves are formed in each of the front and back sides of the tab 203 to extend in a direction crossing the direction in which the tab 203 is extended.

In this embodiment, the first latch member 204 is made up of a pair of latch pawls 204*a* locked respectively to first catch holes 150 in the ink tank 102*a* shown in FIG. 5, and a protective member 204*b* for covering the surrounding of the fulcrum portion (base end portion) 109*a* (FIG. 1) of the latch lever 109 in a non-contact fashion. A hole 201*a* is formed in an area of the bottom wall portion 201, which is in opposite relation to the latch pawls 204*a*, to weaken the strength of the bottom wall portion 201 in its part close to the tab 203. In addition to the function of protecting the latch lever 109, the protective member 204*b* also has a function of serving as a reinforcing rib for the first latch member 204 provided at a base end of the tab 203. Thus, the protective member 204*b* is effective in increasing the rigidity of the first latch member 204 to such an extent that, when a force for attaching or detaching the cap 200 to or from the ink tank is applied to the tab 203, the force is surely transmitted to the bottom wall portion 201.

On the other hand, the second latch member 205 in this embodiment has a catch hole 205*a* formed therein for catching the above-mentioned lock member (second engagement member) 103*a* by which the ink tank is fitted to the recording head. Here, the height of each latch claw 204*a* of the first latch member 204 provided near the tab 203 with respect to the bottom wall portion 201 is lower than the height of the catch hole 205*a* of the second latch member 205 remote from the tab 203 with respect to the bottom wall portion 201.

The bottom wall portion 201 serves as a portion for coupling the first latch member 204 and the second latch member 205, and has ribs 206*a*, 206*b* partly provided at both side edges thereof to extend in a direction toward the second latch member 205 from the first latch member 204. In this embodiment, the ribs 206*a*, 206*b* are disposed so as to cover the elastic sealing member 202 from both the opposite sides spaced crossing the direction toward the second latch member 205 from the first latch member 204 of the cap. Of the two ribs 206*a*, 206*b*, the rib 206*b* located on the rear side of the elastic sealing member 202 as viewed in FIG. 8 is extended from the second latch member 205, whereas the rib 206*b* located on the front side of the elastic sealing member 202 is extended from a point away from the second latch member 205.

Figure 11:
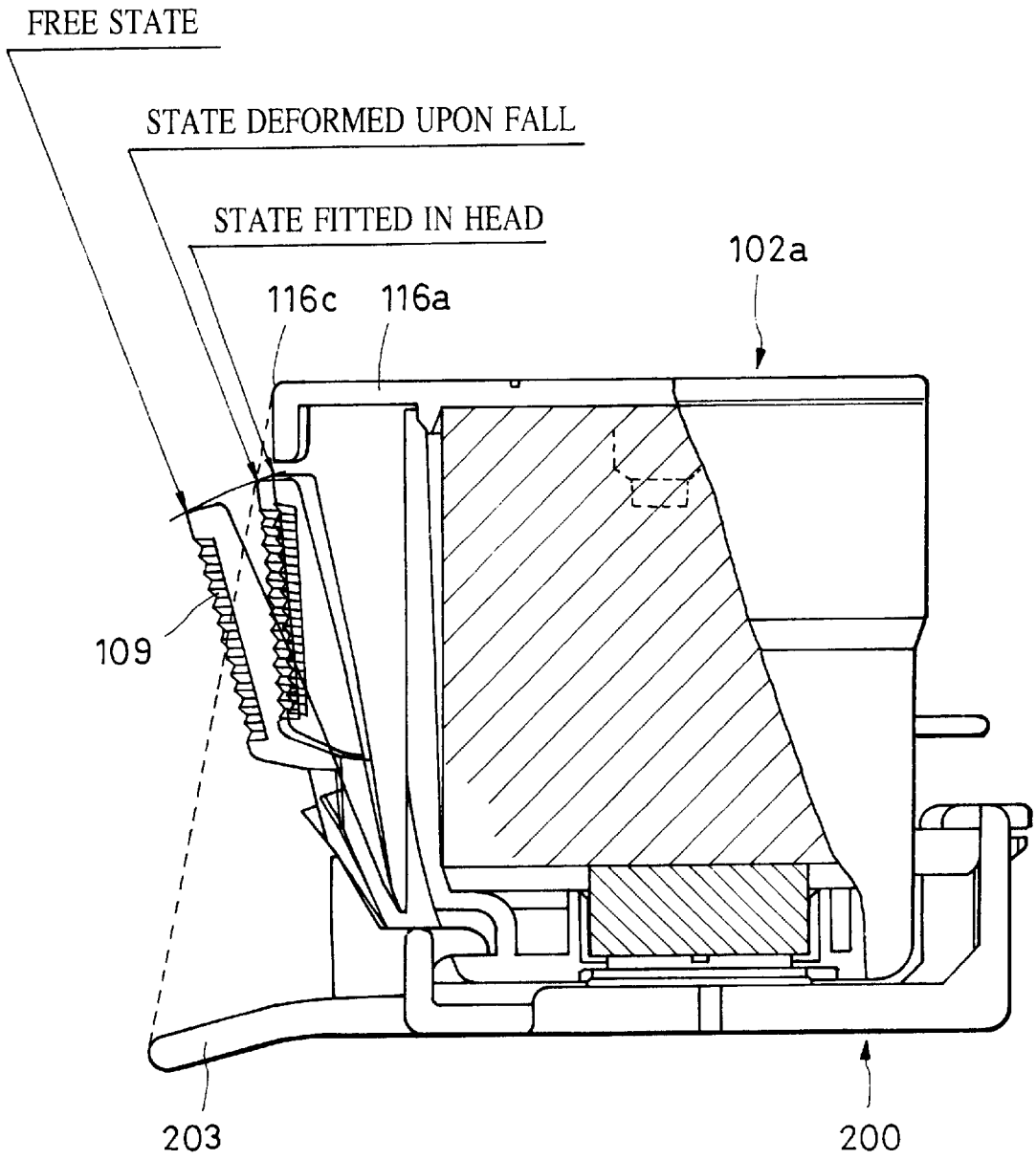
FIG. 11 an explanatory view, partly sectioned, for explaining a state in which the cap is fitted to the ink tank of the present invention.

A description will now be made of a state where the above-described cap is fitted to the ink tank of the present invention with reference to FIG. 11. FIG. 11 is an explanatory view, partly sectioned, for explaining a state in which the cap 200 shown in FIG. 8 is fitted to the ink tank 102*a* shown in FIG. 5. As is apparent from FIGS. 5 and 8, a straight line (dotted line in FIG. 8) connecting the projected end 116*c* of the projection 116*a* of the ink tank 102*a* and a distal end of the tab 203 of the cap 200 is set to cross the latch lever 109 ("free state" in FIG. 11) in a state where the cap 200 is just fitted to the ink tank 102*a* (no forces are applied to the latch lever 109), but not to cross the latch lever 109 in a state where the ink tank 102*a* is attached to the ink tank holder ("state fitted in head" in FIG. 11). In other words, the straight line (dotted line in FIG. 11) connecting the projected end 116*c* of the projection 116*a* of the ink tank 102*a* and the distal end of the tab 203 of the cap 200 is set to cross a movable range of the latch lever 109 in which the latch lever 109 is allowed to angularly move with its elastic deformation.

Accordingly, even when an impact is accidentally exerted on the latch lever 109, for example, upon a fall of the ink tank 102*a* in the state where the cap 200 is fitted to the ink tank 102*a*, the latch lever 109 will not deform beyond a "state deformed upon fall" in FIG. 11, and hence there is no risk that the latch lever 109 may be damaged. Also, when the projected end 116*c* of the projection 116*a* of the ink tank 102*a* and the distal end of the tab 203 strike against a flat plane, the latch lever 109 is elastically deformed from the "free state" to the "state deformed upon fall" in FIG. 11, thereby dampening an applied impact. As a result, the cap 200 is effectively prevented from releasing from the ink tank 102*a* in an accidental way.

A description will now be made in detail of a manner of fitting and removing the cap 200 to and from the ink tank 102*a* with reference to FIGS. 12 and 13. FIGS. 12A, 12B, 13A and 13B are schematic explanatory views for explaining, in time series sequence, steps A, B, C and D of removing the cap 200 from the ink tank 102*a* when the cap 200 shown in FIG. 8 is attached to the ink tank 102*a* shown in FIG. 5. The cap is removed from the ink tank through the successive steps A to D. Note that since the cap 200 can be fitted to the ink tank 102*a* in a manner reversed to that in the case of removing the cap 200, i.e., through the steps D, C, B and A, the fitting operation is not described here.

Figure 12A:
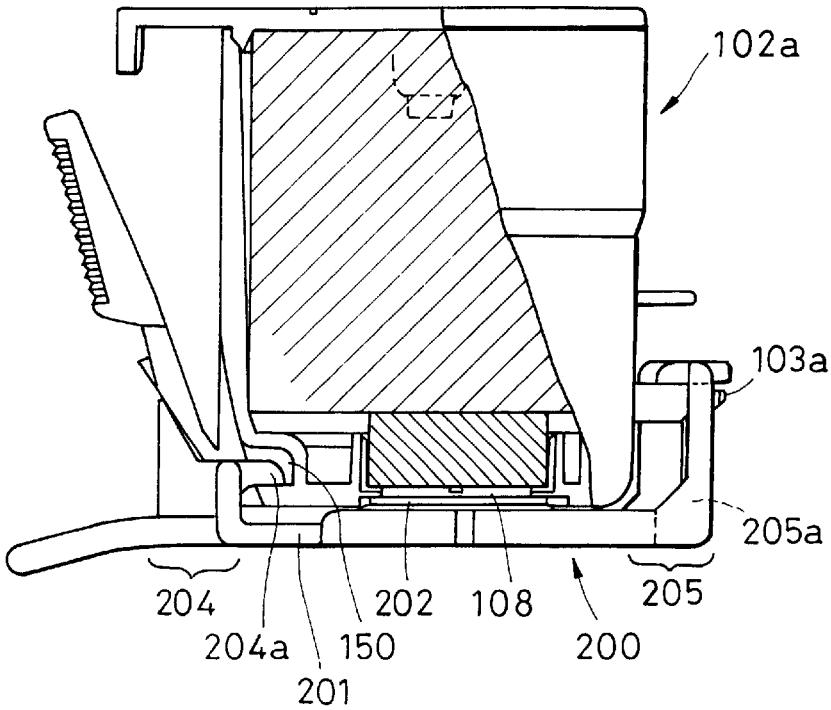
FIGS. 12A and 12B are schematic explanatory views for explaining, in time series sequence, steps A and B of removing the cap from the ink tank when the cap shown in FIG. 8 is attached to the ink tank shown in FIG. 5.

FIG. 12A shows the state where the cap 200 is attached to the ink tank 102*a*. In this state, as described above, the elastic sealing member 202 seals off the ink supply port 108 of the ink tank 102*a*, and the cap 200 is fixed to the ink tank 102*a* with the latch claw 204*a* of the first latch member 204 engaging in the catch hole 150 of the ink tank 102*a* and the lock member 103*a* of the ink tank 102*a* engaging in the catch hole 205*a* of the second latch member 205.

Also, since the elastic sealing member 202 is provided on the bottom wall portion 201 of the cap 200 and the cap 200 is fixed in place at the opposite ends (the first latch member 204 and the second latch member 205) of the bottom wall portion 201, the ink supply port 108 is reliably protected by the state where the cap 200 is attached to the ink tank 102*a*. The length by which the latch claw 204*a* engages in the catch hole 150 is preferably set to a relatively large value so that the cap 200 will not be detached from the ink tank 102*a* with an impact accidentally exerted from a fall, for example. In this embodiment, the length of engagement between the latch claw 204*a* and the catch hole 150 is set to about 3 mm–5 mm.

Figure 12B:
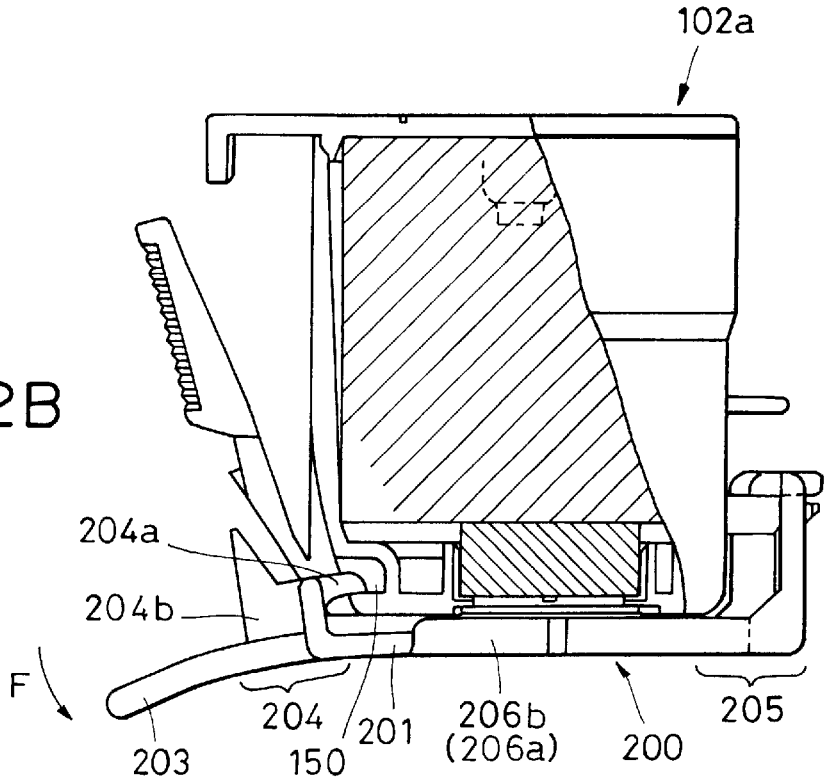

Next, a force F is applied to the tab 203 as shown in FIG. 12B. Upon the force F being applied to remove the cap 200, the bottom wall portion 201 of the cap 200 is forced to elastically deform about fulcrums given by points near ends of the ribs 206*a*, 206*b* on the side nearer to the first latch member 204. Such a deformation of the bottom wall portion 201 causes the latch claw 204*a* of the first latch member 204 to start sliding over a bottom periphery of the catch hole 150 of the ink tank 102*a*. At this time, because the first latch member 204 is formed integrally with the protective member 204*b*, the base portion of the tab 203 is not so deformed and the force F applied to the tab 203 is effectively transmitted to the bottom wall portion 201. Additionally, the force F acts in the same direction as that in which the tab 203 is inclined with respect to the bottom wall portion 201, and this arrangement is effective in further promoting the bottom wall portion 201 to deform in its part near the tab 203 (i.e., an area of the bottom wall portion 201 between the first latch member 204 and the ribs 206*a*, 206*b*).

Moreover, with the tab 203 inclined as described above, in the event that the ink tank 102*a* falls with the ink supply port 108 facing down, for example, the tab 203 serves as a cushion to prevent the cap 200 from being removed accidentally.

On the other hand, a part of the bottom wall portion 201 on the side nearer to the second latch member 205 and the elastic sealing member 202 remain in almost the same state as shown in FIG. 12A due to the effect of provision of the ribs 206*a*, 206*b*.

Next, when the tab 203 is further moved angularly under application of the force F as shown in FIG. 13C, the latch claw 204*a* of the first latch member 204 continues sliding over the bottom periphery of the catch hole 150 of the ink tank 102*a*, the elastic sealing member 202 sealing off the ink supply port 108 of the ink tank 102*a* is partly separated from the bottom wall portion 201 starting from its end nearer to the tab 203, whereupon the sealed-off condition so far established by the elastic sealing member 202 is broken and the ink supply port 108 is released to the atmosphere. On this occasion, an area of the bottom wall portion 201, in which the ribs 206*a*, 206*b* are provided along both the side edges thereof, is preferably elastically deformed to some extent, as shown, from the viewpoint of promoting smooth release of the ink supply port 108 to the atmosphere.

Figure 13A:
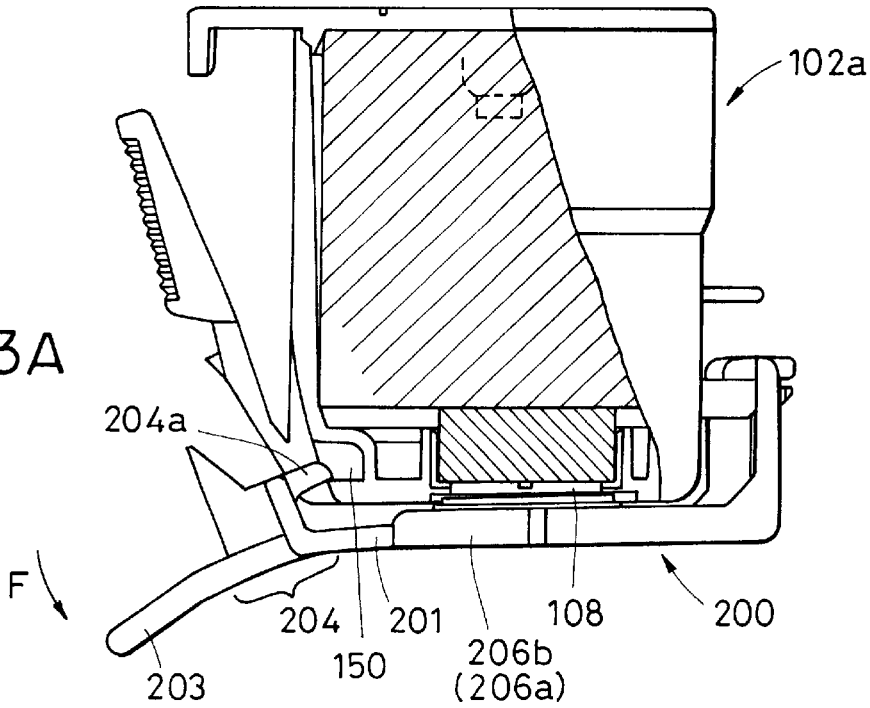
FIGS. 13A and 13B are schematic explanatory views for explaining, in time series sequence, the steps C and D of removing the cap from the ink tank when the cap shown in FIG. 8 is attached to the ink tank shown in FIG. 5.
Figure 13B:
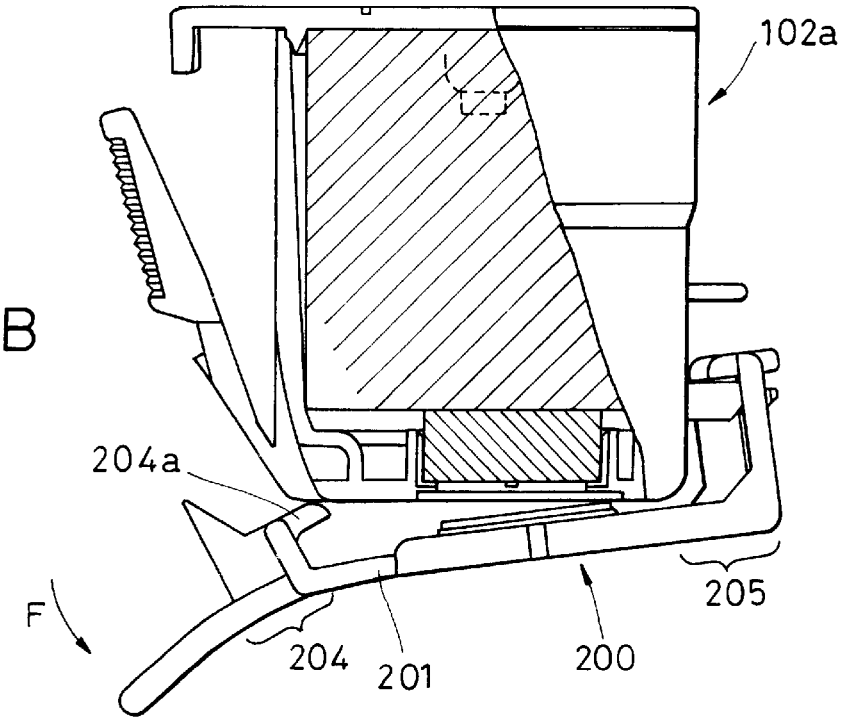

Thereafter, when the tab 203 is further moved angularly, the latch claw 204*a* of the first latch member 204 is disengaged from the catch hole 150 as shown in FIG. 13A. Subsequently, the flexing of the bottom wall portion 201 due to its elastic deformation is moderated, and the cap 200 is allowed to rotate about a fulcrum given by a point near the second latch member 205, and then removed from the ink tank 102*a*. Here, since the height of the first latch member 204 from the bottom wall portion 201 is lower than the height of the second latch member 205 from the bottom wall portion 201, the cap 200 can be smoothly removed without imposing extra forces upon the tab 203 and the bottom wall portion 201.

Thus, in the cap 200 of this embodiment, since at least a part of the bottom wall portion 201 on which the elastic sealing member 202 is provided is deformed under the action of the force applied for removing the cap 200, the cap can be easily opened with a less shock caused upon release of the cap. Further, since the ink supply port is opened more slowly than in the conventional cap, a trouble possibly encountered when the cap is opened, such as scattering of the ink, can be avoided.

Figure 9:
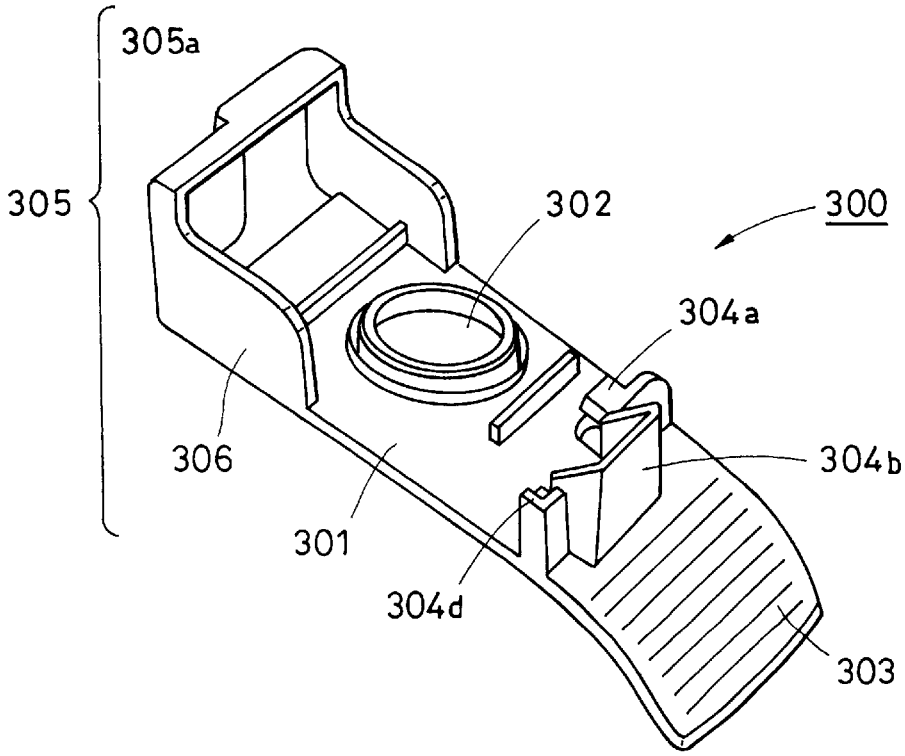
FIG. 9 is a perspective view showing a cap of the present invention applicable to the ink tank shown in FIG. 6.
Figure 10:
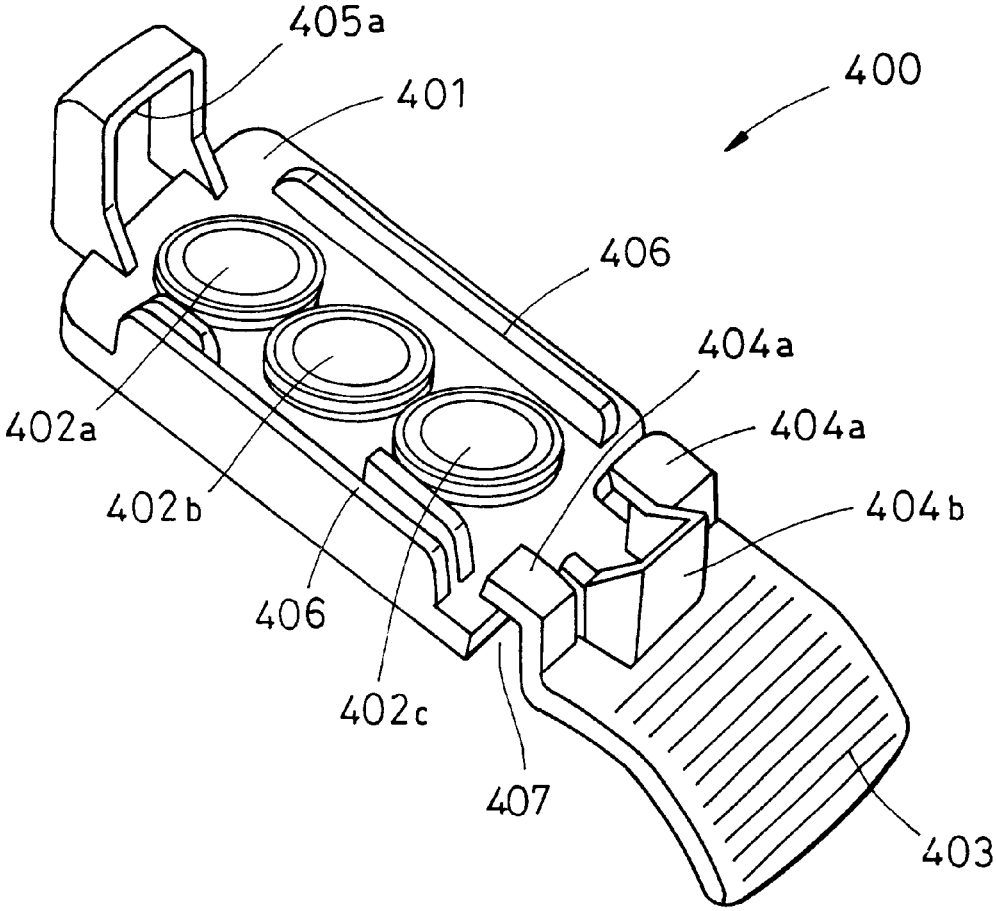
FIG. 10 is a perspective view showing a cap of the present invention applicable to the ink tank shown in FIG. 7.

One example of caps fitted respectively to the ink tanks shown in FIGS. 6 and 7 will be described below with reference to FIGS. 9 and 10. A description of the examples of the caps shown in FIGS. 9 and 10 is made primarily of points differing from the above-described cap shown in FIG. 8. Components of the caps shown in FIGS. 9 and 10 having the same functions as those of the cap shown in FIG. 8 are not described here, but those components are able to fulfill the same effects as described above in connection with FIG. 8.

FIG. 9 is a perspective view of the cap 300 applicable to the black ink tank 102*b* shown in FIG. 6. The cap 300 shown in FIG. 9 comprises a bottom wall portion 301 including an elastic sealing member 302 integrally provided thereon, a tab 303, a first latch member made up of a latch claw 304*a* and a protective member 304*b*, and a second latch member 305 having a catch hole 305*a* which is formed therein and engaged with the lock member (second engagement member) 103*a* provided on the black ink tank 102*b*. The cap 300 of this example differs from the above-described cap 200 shown in FIG. 8 in that the bottom wall portion 301 has a different width, that two ribs 306 are provided integrally with the second latch member 305, are positioned an area not covering the elastic sealing member 302, and have a higher height, and that the first latch member has only one latch claw 304*a* and a tank abutment portion 304*d* is provided for abutment with the bottom surface of the black ink tank 102*b*.

FIGS. 14A, 14B, 15A and 15B schematically show steps of removing the cap 300 shown in FIG. 9 from the black ink tank 102*b* shown in FIG. 6. FIGS. 14A, 14B, 15A and 15B represent states corresponding to those represented by FIGS. 12A, 12B, 13A and 13B.

Figure 14A:
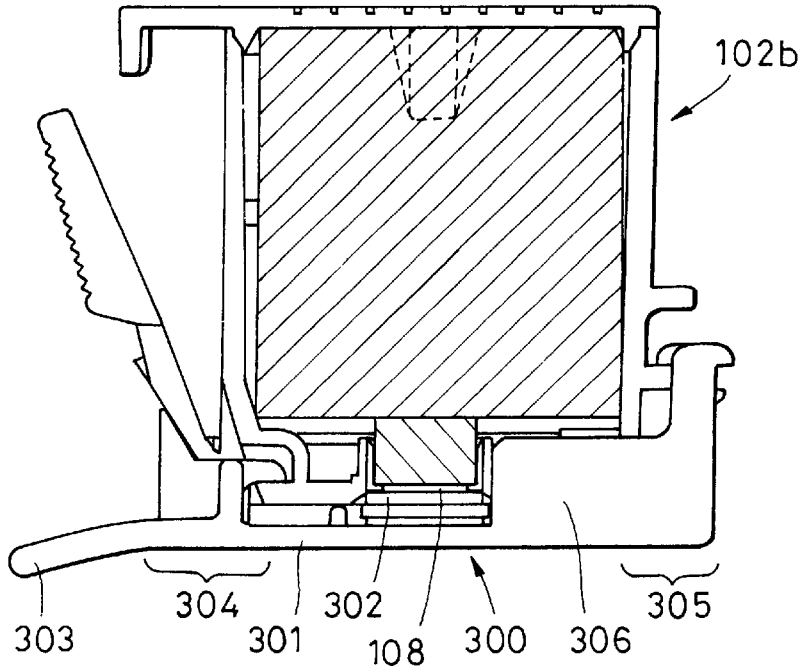
FIGS. 14A and 14B are schematic explanatory views for explaining, in time series sequence, steps A and B of removing the cap from the ink tank when the cap shown in FIG. 9 is attached to the ink tank shown in FIG. 6.
Figure 14B:
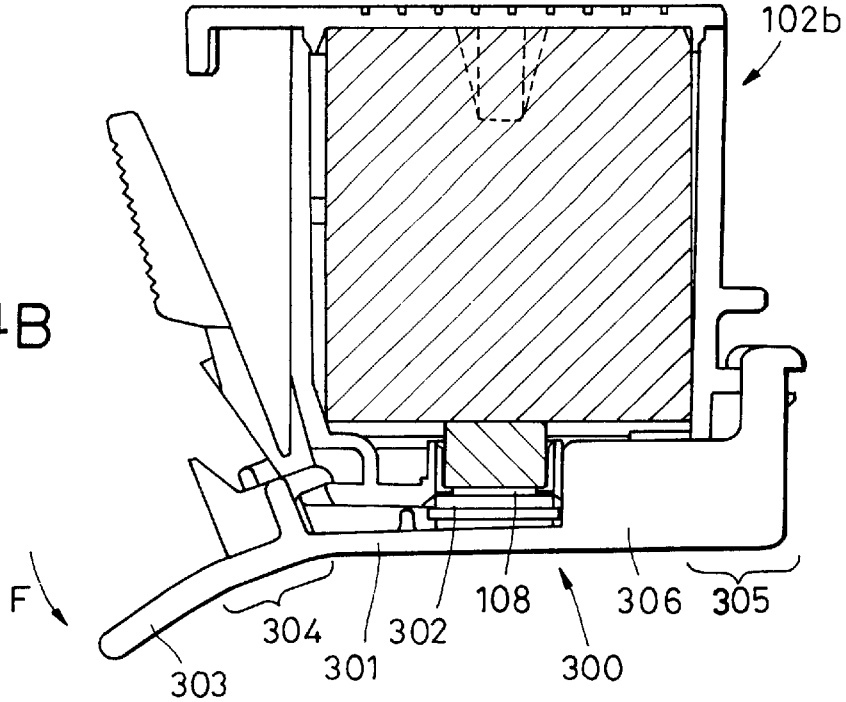
Figure 15A:
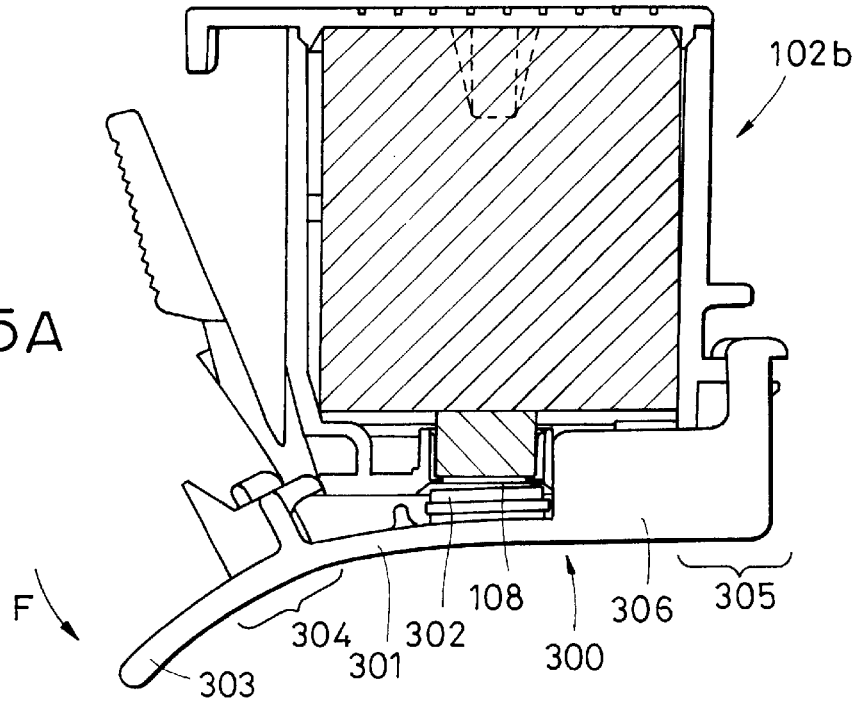
FIGS. 15A and 15B are schematic explanatory views for explaining, in time series sequence, the steps C and D of removing the cap from the ink tank when the cap shown in FIG. 9 is attached to the ink tank shown in FIG. 6.
Figure 15B:
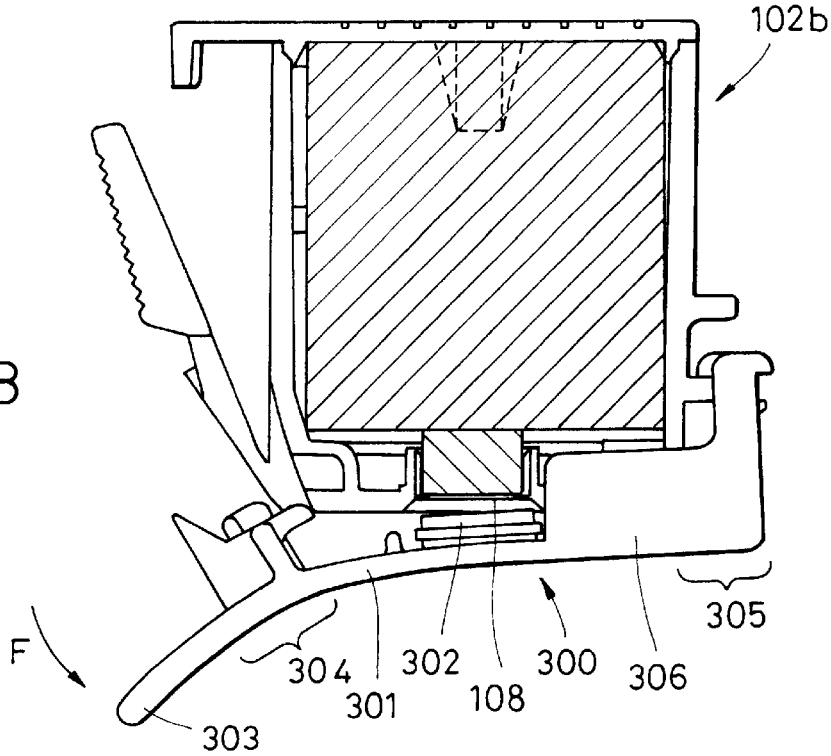

This example of the cap is featured in that, in an initial stage where the user starts application of a force F to the tab 303 as shown in FIG. 14B, the elastic sealing member 302 sealing off the ink supply port 108 of the black ink tank 102*b* is partly separated from the bottom wall portion 301 starting from its end nearer to the tab 303, whereupon the sealed-off condition so far established by the elastic sealing member 302 is broken and the ink supply port 108 is released to the atmosphere. The reason for is that, because the ribs 306 of the cap 300 of this example are not provided in covering relation to the elastic sealing member 302, an area of the bottom wall portion 301 in which the elastic sealing member 302 is provided is also elastically deformed by the force F initially applied to remove the cap. Accordingly, the bottom wall portion 301 of the cap 300 of this example is deformed in larger amount than that of the cap of another example. On the other hand, the second latch member 305 reinforced by the ribs 306 reliably offers a fulcrum when the force F is further applied to rotate the cap 300 as shown in FIG. 15D. As a result, the cap 300 can be provided which has less variations in formation of a fulcrum in products and enables the cap to be rotated about the fulcrum with stability.

FIG. 10 is a perspective view of a cap 400 applicable to the color ink tank 102*c* shown in FIG. 7. The cap 400 shown in FIG. 10 includes a plurality of elastic sealing members 402*a*, 402*b*, 402*c* corresponding to the respective ink supply ports of the color ink tank 102*c*. As with the cap 200 shown in FIG. 8, the cap 400 of this example comprises a bottom wall portion 401 including the elastic sealing member 402*a*, 402*b*, 402*c* integrally provided thereon, a tab 403, a first latch member made up of two latch claws 404*a* and a protective member 404*b*, two ribs 406 provided to extend along both side edges of the bottom wall portion 401, and a second latch member 405 having a catch hole 305*a* formed therein. The cap 400 of this example differs from the above-described cap 200 shown in FIG. 8 in that a notch 407 is formed in an area of the bottom wall portion 401 near the tab 403.

FIGS. 16A, 16B, 17A and 17B schematically show steps of removing the cap 400 shown in FIG. 10 from the color ink tank 102*c* shown in FIG. 7. FIGS. 16A, 16B, 17A and 17B represent states corresponding to those represented by FIGS. 12A, 12B, 13A and 13B.

In the cap 400 of this example, since a plurality of ink supply ports are provided in the color ink tank 102*c*, the ink supply ports are opened successively from the one located nearest to the first latch member. Therefore, the ink supply ports for the inks of three colors are not opened at the same time. In addition, since the ink supply ports are each fully opened after being slightly released to the atmosphere as described above, there is no risk that the inks might scatter upon opening the ink supply ports and might mix with each other.

Figure 16A:
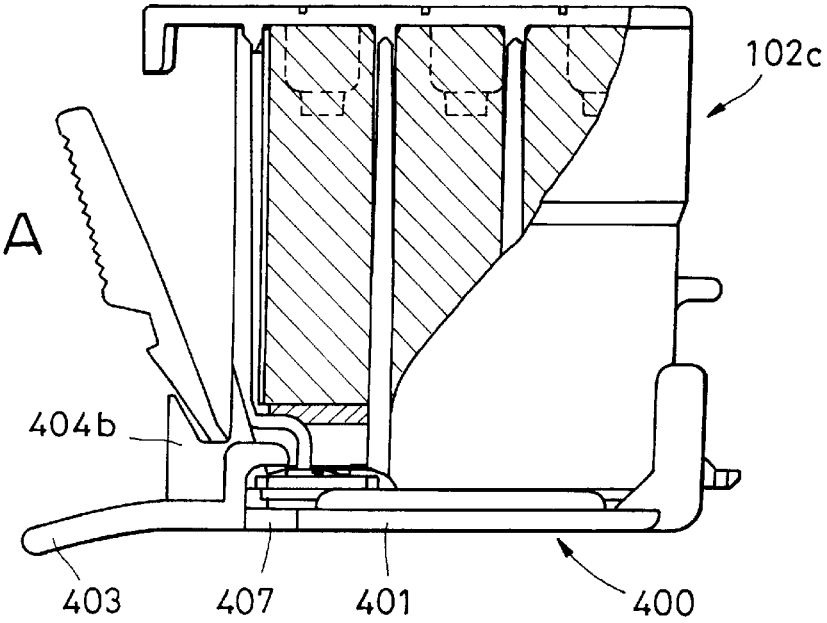
FIGS. 16A and 16B are schematic explanatory views for explaining, in time series sequence, steps A and B of removing the cap from the ink tank when the cap shown in FIG. 10 is attached to the ink tank shown in FIG. 7.
Figure 16B:
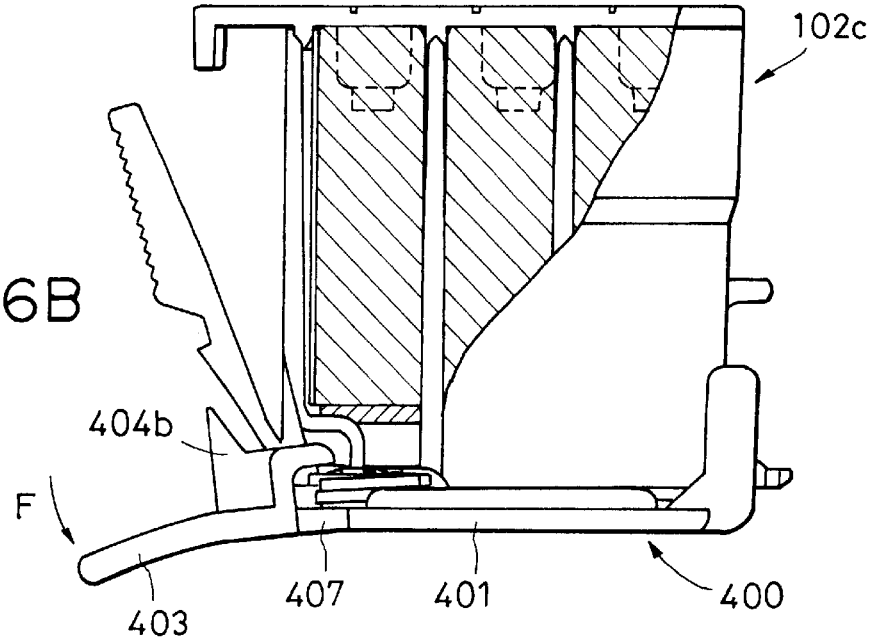
Figure 17A:
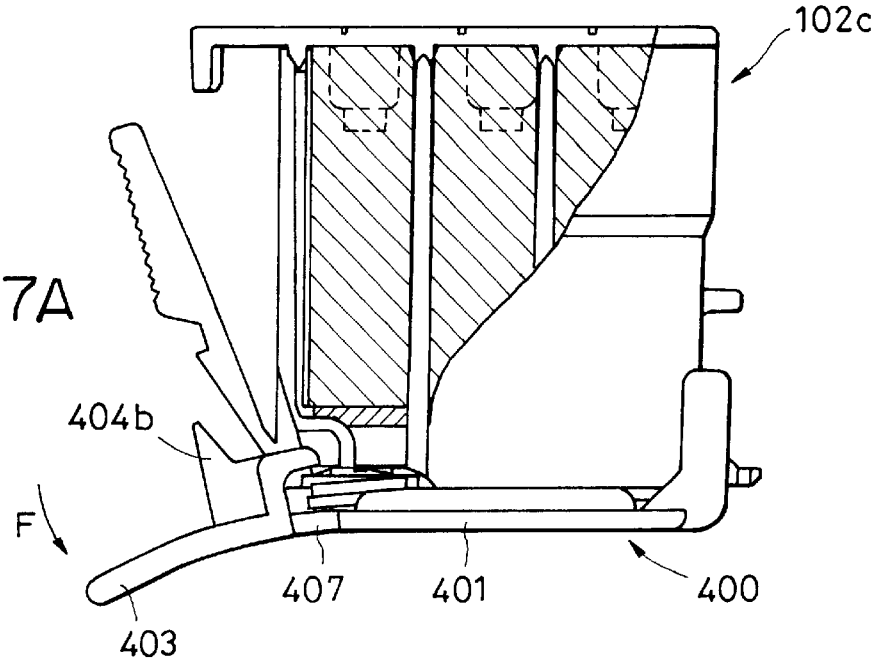
FIGS. 17A and 17B are schematic explanatory views for explaining, in time series sequence, the steps C and D of removing the cap from the ink tank when the cap shown in FIG. 10 is attached to the ink tank shown in FIG. 7.
Figure 17B:
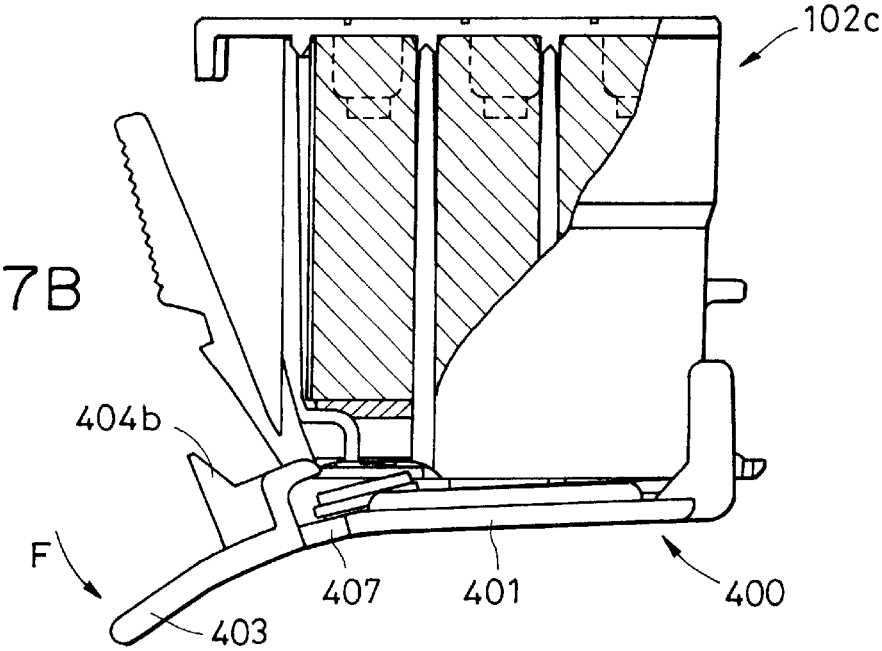

Also, in the cap 400 of this example, since the notch 407 is formed in the bottom wall portion 401, the elastic deformation of the bottom wall portion 401 in its area on the side nearer to the tab 403 is promoted by the presence of the notch 407 in states shown in FIGS. 16B and 17A. As with the cap 200 described above in connection with FIG. 12, the protective member 404*b* of the first latch member also acts as a reinforcing rib at a base portion of the tab 403 in the cap 400 of this example. Accordingly, the force F applied for removing the cap 400 is efficiently transmitted to the bottom wall portion 401, whereby the elastic deformation of the bottom wall portion 401 in its area including the notch 407 is further promoted.

Note that the cap of the present invention can be constructed as described above regardless of whether a latch lever is provided on the ink tank, or whether the projection is provided for protection of the latch lever. However, since the advantages described above in connection with FIG. 11 can be obtained by providing the latch lever and the projection, it is more preferable that the cap of the present invention be employed as a cap fitted to the ink tank including the latch lever and the projection.

(Carriage)

Figure 18:
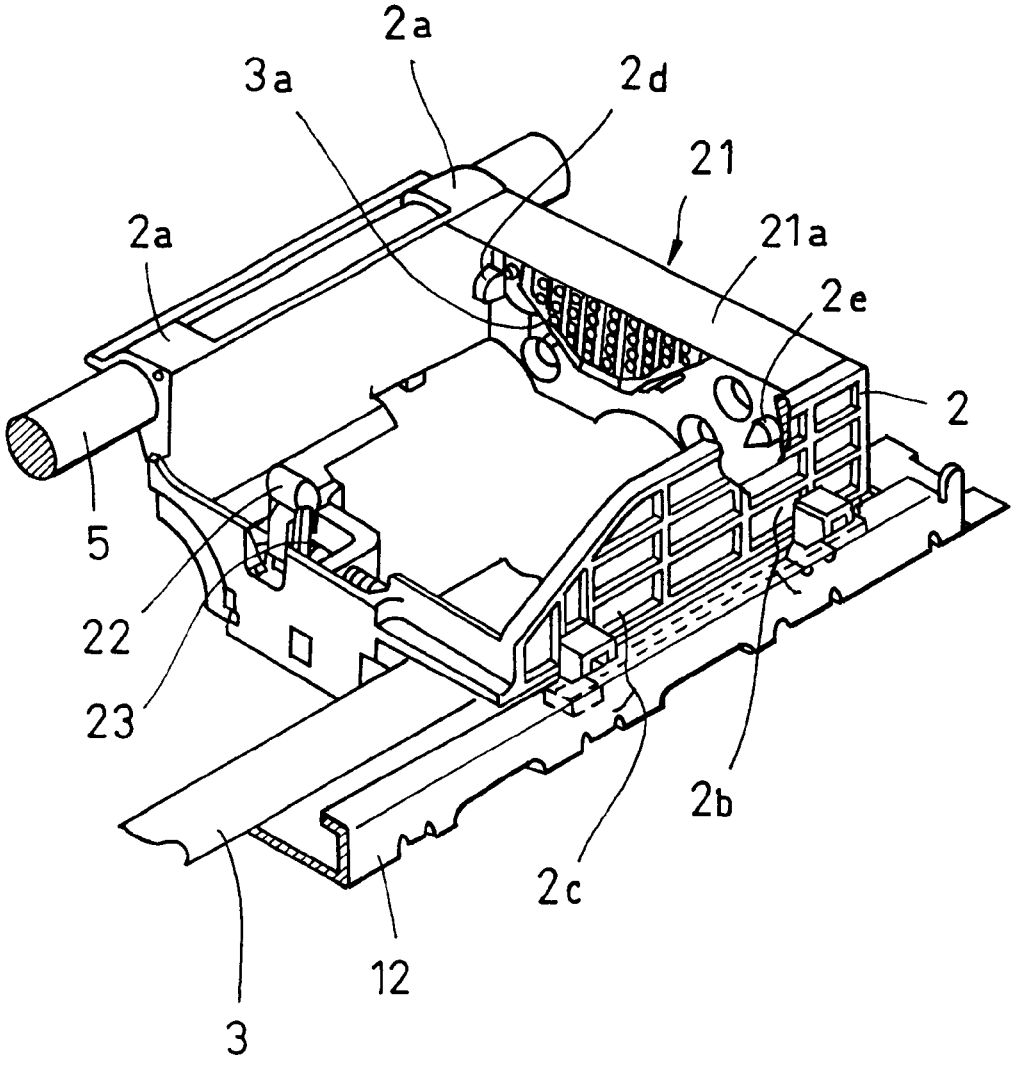
FIG. 18 is a perspective view showing one example of the construction of a carriage provided on an ink jet recording apparatus.

A carriage for holding the ink tank of the present invention in a detachable manner will be described below with reference to FIG. 18. FIG. 18 is a perspective view showing one example of the construction of a carriage provided on an ink jet recording apparatus.

As shown in FIG. 18, a carriage 2 is in the form of a frame as a whole, and a recording head cartridge 1 (see FIG. 19 described later) is mounted in a hollow portion of the carriage 2. Two bearings 2*a* are provided integrally with a rear wall of the carriage 2, and a guide shaft 5 is inserted through the two bearings 2*a*. Also, a front wall of the carriage 2 is provided integrally with two gripping portions, i.e., a guide rail gripper 2*b* and a carriage deformation preventing stopper 2*c*. The guide rail gripper 2*b* is disposed on the side nearer to a cable retainer 21, and the carriage deformation preventing stopper 2*c* is disposed on the side nearer to a head guide 22. The guide rail gripper 2*b* and the carriage deformation preventing stopper 2*c* are each made up of two members which are projected from the front wall of the carriage 2 to position respectively above and below a plate-shaped guide rail 12 with a certain spacing left between the two members in the vertical direction. In this way, the carriage 2 is supported by the two bearings 2*a*, the guide rail gripper 2*b* and the carriage deformation preventing stopper 2*c*. Accordingly, the carriage 2 is supported parallel to a base 14 (see FIG. 19) so that the distance between a nozzle portion (see FIG. 4) of the recording head cartridge mounted on the carriage 2 and a recording medium is kept substantially constant.

A flexible cable 3 is arranged to extend along a predetermined route, and a cable terminal unit 3*a* provided at a fore end of the flexible cable 3 is fixed by the cable retainer 21 such that the cable terminal unit 3*a* is positioned inside a right side wall of the carriage 2 as viewed in FIG. 18. When the recording head cartridge 1 is mounted on the carriage 2, a head terminal unit (not shown) of the recording head cartridge 1 is held in close contact with the cable terminal unit 3*a* to establish electrical connection between the cable terminal unit 3*a* and the recording head cartridge 1.

Two head positioning lugs 2*d*, 2*e* are integrally provided on the right side wall of the carriage 2 to which the cable terminal unit 3*a* is positioned in adjacent relation. One head positioning lug 2*d* is rectangular in section and is disposed on the rear side of the cable terminal unit 3*a*. The other head positioning lug 2*e* is circular in section with its fore end having a conical shape and is disposed on the front side of the cable terminal unit 3*a*. In the state where the recording head cartridge 1 is mounted on the carriage 2, the one head positioning lug 2*d* is fitted to a head positioning cutout (not shown) formed in the recording head cartridge 1 and the other head positioning lug 2*e* is fitted to a head positioning hole(not shown) formed in the recording head cartridge 1, whereby the recording head cartridge 1 is precisely positioned with respect to the carriage 2.

A contact spring 23 is disposed in the carriage 2 at a position opposite to the cable terminal unit 3*a*, and a head guide 22 formed of a resin molding is fixed to a fore end of the contact spring 23. In other words, the head guide 22 is resiliently supported to the carriage 2. In the state where the recording head cartridge 1 is mounted on the carriage 2, the head guide 22 is fitted to a head pressing portion (not shown) of the recording head cartridge 1 so that the recording head cartridge 1 is biased toward the cable terminal unit 3*a* by a resilient force of the contact spring 23. With the opposite arrangement of the cable terminal unit 3*a* and the head guide 22, contact between the cable terminal unit 3*a* and the head terminal unit can be surely maintained. Additionally, the head guide 22 also serves as a guide at the time of mounting the recording head cartridge 1 on the carriage 2.

(Ink Jet Recording Apparatus)

Figure 19:
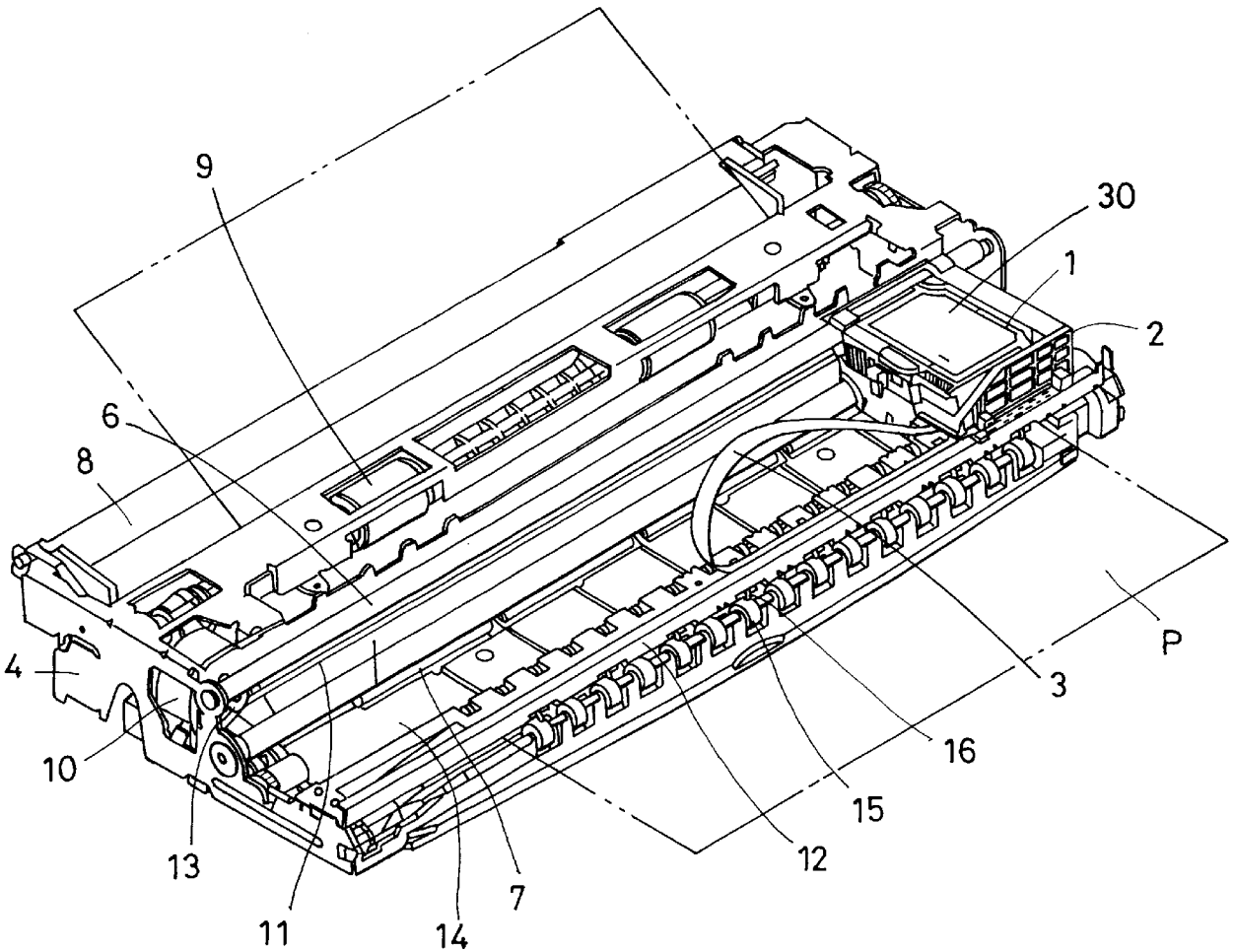
FIG. 19 is a perspective view showing one example of the construction of an ink jet recording apparatus including a recording head cartridge mounted thereon.

An ink jet recording apparatus including a recording head cartridge, to which the ink tank of the present invention can be attached, will be described below with reference to FIG. 19. FIG. 19 is a perspective view showing one example of the construction of an ink jet recording apparatus including the recording head cartridge mounted thereon. Note that FIG. 19 shows a state where a cover is removed.

Referring to FIG. 19, the carriage 2 mounts thereon the recording head cartridge 1 in a detachable manner. The carriage 2 is slidably supported by the guide shaft 5 and the guide rail 12, which are fixed at their both ends to a frame 4 and arranged parallel to each other, such that the carriage 2 can slide perpendicularly to the feeding direction of a recording medium (sheet of paper) P and parallel to the surface of the recording medium P. Also, the carriage 2 is coupled to a part of a carriage driving belt 11 that is stretched between a driver pulley 13 fixed to an output shaft of a carriage driving motor 10 and a driven pulley (not shown) rotatably supported in place. When the carriage driving motor 10 is energized for rotation, the carriage driving belt 11 is driven to run round both the pulleys, thus causing the carriage 2 to reciprocate in a direction perpendicular to the feeding direction of the recording medium P.

A recording signal is transmitted, for example, from a control board (not shown) for controlling the operation of the ink jet recording apparatus to the nozzle portion of the recording head cartridge 1 through the flexible cable 3 provided in the carriage 2. The flexible cable 3 is arranged to extend in the moving direction of the carriage 2 and forms a loop that increases and decreases with the movement of the carriage 2.

On the other hand, the recording medium P is placed on a platen 8 rotatably supported at its both ends by the frame 4. The platen 8 is biased by a biasing means (not shown) toward a pickup roller 9 so that the recording medium P placed on the platen 8 is pressed against the pickup roller 9. When the pickup roller 9 is rotated in accordance with a paper feed command, the recording medium P is advanced by a frictional force developed between the pickup roller 9 and the recording medium P. The platen 8 includes a separating means (not shown), such as a separating claw, which is used in a conventional automatic paper feeder. Under the action of the separating means, only one piece of the recording medium P lying at the uppermost position is advanced.

The recording medium P advanced by the pickup roller 9 is fed toward a position below the carriage 2 while it is held between a feed roller 6 supported at its both ends by the frame 4 and a pinch roller 7 provided on the base 14. At the position below the carriage 2, an image is recorded on the recording medium P. Paper ejection rollers 15 and spurs 16 are disposed in opposite relation downstream of the carriage in the feeding direction of the recording medium P. The recording medium P having passed below the carriage 2 is held between the paper ejection rollers 15 and the spurs 16 and then ejected. The pickup roller 9, the feed roller 6 and the paper ejection rollers 15 are driven by using a paper feed motor (not shown) as a driving source.

According to the liquid container of the present invention, as described above, a projection is provided in an area of a housing which is opposite to a lever provided on the housing and is away from a supported end of the lever, the projection covering at least a part of a space between a free end of the lever and the housing in the above area. Therefore, the lever can be protected against accidental external forces with a simple construction without causing wasteful use of a space necessary for attaching and detaching the liquid container to and from a holder or the like.

According to the cap-equipped liquid container of the present invention, a straight line connecting a projected end of the projection of the liquid container and a distal end of a tab of a cap is set to cross a movable range of the lever provided on the liquid container in which the lever is allowed to angularly move with elastic deformation thereof. Therefore, the lever will not deform beyond the allowable range of elastic deformation even when an impact is accidentally exerted on the liquid container upon a fall, for example. As a result, the lever can be protected against damages. Also, when the projected end of the projection of the liquid container and the distal end of the tab of the cap strike against a flat plane, the lever is elastically deformed so as to dampen an applied impact. It is hence possible to effectively prevent the cap from being accidentally removed from the liquid container.

According to the cap of the present invention, an elastic sealing member for sealing off the surroundings of the supply port of the liquid container is provided on a bottom wall portion connecting first and second latch members to each other. Therefore, the supply port is surely protected by the bottom wall portion. Also, since a part of the bottom wall portion is able to elastically deform upon application of an operating force for removing the cap from the liquid container, a shock occurred upon opening the supply port of the liquid container is reduced and the cap can be easily removed without troubles.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A liquid container comprising:

a housing for containing a liquid therein;

a lever having one end supported to an outer wall of said housing and the other end as a free end, said lever being elastically deformable; and a projection provided in an area of said housing which is opposite to and away from the supported one end of said lever, said projection covering at least a part of a space between the free end of said lever and said housing in said area;

wherein said projection extends from the upper surface of said housing and exists above the free end of said lever.

2. A liquid container comprising:

a housing for containing a liquid therein;

a lever having one end supported to an outer wall of said housing and the other end as a free end, said lever being elastically deformable; and a projection provided in an area of said housing which is opposite to and away from the supported one end of said lever, said projection covering at least a part of a space between the free end of said lever and said housing in said area;

wherein a projected end of said projection is bent toward the free end of said lever.

3. A liquid container according to claim 1, wherein said liquid container is detachably attachable to a holder for said liquid container in a state that the free end of said lever is elastically deformed toward said housing; and wherein a distance between a projected end of said projection and said housing is not smaller than a distance between the free end of said lever and said housing in a state that said liquid container is attached to said holder.

4. A cap-equipped liquid container comprising a liquid container according to claim 1 and a cap fitted to said liquid container, wherein said cap comprises:

an elastic sealing member for sealing off a supply port formed in said liquid container, said supply port for introducing a liquid in said liquid container out of said liquid container, and a cap body on which said elastic sealing member is provided, wherein said cap body includes an engagement member engaging with said liquid container to hold said cap in place, and a tab disposed near said engagement member and used for removing said cap from said liquid container; and wherein a straight line connecting a projected end of a projection of said liquid container and a distal end of said tab is set to cross a movable range of a lever provided on said liquid container in which said lever is allowed to angularly move with elastic deformation thereof.

5. A cap-equipped liquid container according to claim 4, wherein said tab is provided to lie in a direction of extension of a surface of said cap body on which said elastic sealing member is provided, and a part of the surface of said cap body is elastically deformable with application of an operating force for removing and fitting said cap.

6. A liquid container according to claim 2, wherein said liquid container is detachably attachable to a holder for said liquid container in a state that the free end of said lever is elastically deformed toward said housing; and wherein a distance between a projected end of said projection and said housing is not smaller than a distance between the free end of said lever and said housing in a state that said liquid container is attached to said holder.

* * * * *

UNITED STATES PATENT AND TRADEMARK OFFICE

CERTIFICATE OF CORRECTION

PATENT NO. : 6,623,104 B1
DATED : October 4, 2000
INVENTOR(S) : Yasuo Kotaki et al.

It is certified that error appears in the above-identified patent and that said Letters Patent is hereby corrected as shown below:

Title page,
Item [56], References Cited, U.S. PATENT DOCUMENTS, the following should be inserted:

| | | | |
|---|---|---|---|
| -- 5,589,862 | 12/1996 | Ujita, et al. | 347/87 |
| 5,619,237 | 04/1997 | Inoue, et al. | 347/86 |
| 5,742,310 | 04/1998 | Kotaki | 347/86 -- |

FOREIGN PATENT DOCUMENTS, should read:

| | | |
|---|---|---|
| -- 08058107 | 03/1996 | Japan |
| 08224883 | 09/1996 | Japan |
| 08276601 | 10/1996 | Japan -- |

Signed and Sealed this

Nineteenth Day of October, 2004

JON W. DUDAS
*Director of the United States Patent and Trademark Office*